US008164610B2

(12) United States Patent
Nakata et al.

(10) Patent No.: US 8,164,610 B2
(45) Date of Patent: Apr. 24, 2012

(54) APPARATUS FOR WRITING AN IMAGE ON THE TARGET OBJECT TO BE MANAGED

(75) Inventors: Yoshiko Nakata, Kanagawa (JP); Tsutomu Nakajima, Kanagawa (JP); Noriyuki Ochiai, Kanagawa (JP); Yukiko Sahashi, Tokyo (JP); Yoshihiko Hotta, Shizuoka (JP); Shinya Kawahara, Shizuoka (JP); Hiroshi Uenishi, Kanagawa (JP); Tomomi Ishimi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 766 days.

(21) Appl. No.: 12/028,307

(22) Filed: Feb. 8, 2008

(65) Prior Publication Data

US 2008/0192618 A1 Aug. 14, 2008

(30) Foreign Application Priority Data

Feb. 9, 2007 (JP) ..... 2007-031232

(51) Int. Cl.
*B41J 2/435* (2006.01)

(52) U.S. Cl. ..... 347/224; 369/13.01

(58) Field of Classification Search ..... 347/24, 347/224; 369/13.01
See application file for complete search history.

(56) References Cited

U.S. PATENT DOCUMENTS 4,477,843 A * 10/1984 Kinjo et al. ..... 386/206
4,530,080 A * 7/1985 Aoi et al. ..... 369/44.13
5,216,658 A * 6/1993 Clark ..... 369/100
5,267,034 A * 11/1993 Miyatake et al. ..... 348/352
5,317,337 A * 5/1994 Ewaldt ..... 347/2
5,371,730 A * 12/1994 Maeda et al. ..... 720/725
5,376,511 A * 12/1994 Tatezono et al. ..... 430/270.15
5,481,510 A * 1/1996 Masaki et al. ..... 369/30.13
5,526,020 A * 6/1996 Campanelli et al. ..... 382/165
5,554,196 A * 9/1996 Wielstra ..... 8/444
5,783,343 A * 7/1998 Tombs et al. ..... 430/47.2
5,854,175 A * 12/1998 DeBoer et al. ..... 503/227
5,892,742 A * 4/1999 Yamashita et al. ..... 369/44.27
6,633,521 B1 * 10/2003 Mochizuki et al. ..... 369/44.29
7,172,991 B2 * 2/2007 Anderson et al. ..... 503/206

(Continued)

FOREIGN PATENT DOCUMENTS

EP 430162 A * 6/1991
EP 619528 A1 * 10/1994
JP 02206047 A * 8/1990
JP 06-183039 7/1994

(Continued)

OTHER PUBLICATIONS

Office Action issued Nov. 8, 2011 in corresponding Japanese Patent Application No. 2007-031232 filed Feb. 9, 2007.

*Primary Examiner* — Charlie Peng
*Assistant Examiner* — Peter Radkowski
(74) *Attorney, Agent, or Firm* — Oblon, Spivak, McClelland, Maier & Neustadt, L.L.P.

(57) ABSTRACT

A surface-condition-information obtaining unit obtains information on a surface condition of a rewritable display medium on which information is reversely displayed visually. A write-laser output unit outputs a write laser to irradiate the rewritable display medium with the write laser, to perform a drawing on the rewritable display medium. A control unit performs a write process for displaying an image on the rewritable display medium by adjusting a laser output condition based on the information obtained by the surface-condition-information obtaining unit and controlling the write-laser output unit based on an adjustment of the laser output condition.

14 Claims, 13 Drawing Sheets

U.S. PATENT DOCUMENTS

| | | | | |
|---|---|---|---|---|
| 7,501,172 | B2 * | 3/2009 | Anderson et al. | 428/64.4 |
| 7,637,435 | B2 * | 12/2009 | Iwakata et al. | 235/492 |
| 2002/0159347 | A1 * | 10/2002 | Sasaki et al. | 369/44.37 |
| 2002/0191517 | A1 * | 12/2002 | Honda et al. | 369/53.29 |
| 2003/0108708 | A1 * | 6/2003 | Anderson et al. | 428/64.4 |
| 2004/0052165 | A1 * | 3/2004 | Kuribayashi et al. | 369/13.27 |
| 2005/0137584 | A1 * | 6/2005 | Lemchen | 606/1 |
| 2005/0255599 | A1 * | 11/2005 | Wang et al. | 436/56 |
| 2006/0000814 | A1 * | 1/2006 | Gu et al. | 219/121.69 |
| 2006/0262178 | A1 * | 11/2006 | Anderson et al. | 347/224 |
| 2007/0036039 | A1 * | 2/2007 | Kawahara et al. | 369/13.01 |
| 2007/0063058 | A1 * | 3/2007 | Iwakata et al. | 235/492 |
| 2008/0073438 | A1 * | 3/2008 | Gu et al. | 235/494 |
| 2008/0252728 | A1 * | 10/2008 | Landau | 348/145 |

FOREIGN PATENT DOCUMENTS

| | | | |
|---|---|---|---|
| JP | 07-052420 | | 2/1995 |
| JP | 08-096092 | | 4/1996 |
| JP | 11-300991 | | 11/1999 |
| JP | 2001-277491 | | 10/2001 |
| JP | 2002-215038 | | 7/2002 |
| JP | 2003-346195 | | 12/2003 |
| JP | 2004-258699 | | 9/2004 |
| JP | 2004-295401 | | 10/2004 |
| JP | 2006-231647 | | 9/2006 |
| JP | 2007-76768 | | 3/2007 |
| JP | 2007076122 | A * | 3/2007 |
| WO | WO 2005076036 | A1 * | 8/2005 |

* cited by examiner

APPARATUS FOR WRITING AN IMAGE ON THE TARGET OBJECT TO BE MANAGED

CROSS-REFERENCE TO RELATED APPLICATIONS

The present application claims priority to and incorporates by reference the entire contents of Japanese priority document 2007-031232 filed in Japan on Feb. 9, 2007.

BACKGROUND OF THE INVENTION

1. Field of the Invention

The present invention relates to a laser rewriting system that performs writing with respect to a rewritable recording medium.

2. Description of the Related Art

Recently, information recording media having various pieces of electronic information stored therein are used. A printing technique of visualizing electronic information stored in such information recording media has been disclosed (see, for example, Japanese Patent Application Laid-open No. 2004-258699 (page 1 and FIG. 1)). According to the technique described in Japanese Patent Application Laid-open No. 2004-258699, the information recording medium includes a rewrite area in which change information including at least one image can be rewritten as visual information, and a base material of the recording medium having a storage area for storing electronic information. An area for printing image information according to a photograph of a holder's face and a usage history, and an area for printing holder's individual information and an image corresponding thereto are arranged in the rewrite area of the information recording medium, and the rewrite area can be rewritten according to the photograph and update information prepared by the holder according to a sublimation dye transfer printing method.

Further, a technique relating to an information recording medium having a memory area for storing process control information and a rewritable area for displaying the process control information stored in the memory area as visual information has been disclosed (see, for example, Japanese Patent Application Laid-open No. 2004-295401 (page 1)). According to the technique described in Japanese Patent Application Laid-open No. 2004-295401, the information recording medium includes an integrated circuit (IC) area for storing the process control information for each predetermined process, and a rewritable area for displaying the stored process control information as visual information. The information recording medium can access a rewritable apparatus for rewriting the visual information associated with each process and displayed in the rewritable area via a communication unit. The information recording medium includes a process selecting unit, a process control information reader, and a rewrite instructing unit. The information recording medium selects a process corresponding to the accessed rewritable apparatus from the IC area, reads the process control information corresponding to the selected process, and instructs the rewritable apparatus to rewrite the information based on the process control information.

According to the above techniques, however, when the displayed content is to be changed, electronic equipment such as an information processor and a printer is required. However, when operations and the like are performed in various environments, it is troublesome to perform the rewriting operation by using the electronic equipment. Particularly, when the information recording medium is attached to an object to be managed such as a commercial product, an operation to detach the information recording medium from the object and reattach the information recording medium to the object after rewriting is required every time rewriting is performed.

When the detachment and reattachment are performed, not only the efficiency of the original process is deteriorated, but also a stress is applied to the information recording medium, thereby causing deterioration thereof. Further, because rewriting is repeatedly performed with respect to the information recording medium, there are needs for improvement of rewriting efficiency.

SUMMARY OF THE INVENTION

It is an object of the present invention to at least partially solve the problems in the conventional technology.

According to an aspect of the present invention, there is provided a laser rewriting system including a surface-condition-information obtaining unit that obtains information on a surface condition of a rewritable display medium on which information is reversely displayed visually, which is provided on a target object to be managed; a write-laser output unit that outputs a write laser to irradiate the rewritable display medium with the write laser, to perform a drawing on the rewritable display medium; and a control unit that performs a write process for displaying an image on the rewritable display medium by adjusting a laser output condition based on the information obtained by the surface-condition-information obtaining unit and controlling the write-laser output unit based on an adjustment of the laser output condition.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

A first embodiment of the present invention is explained with reference to FIGS. 1 and 2. In the first embodiment, a laser rewriting system that performs writing by using a laser with respect to rewritable recording-medium attached to a container is explained. The laser rewriting system is used for, for example, newly rewriting a content of a product packed in the container to be used for delivery or information of a delivery destination.

Figure 1:
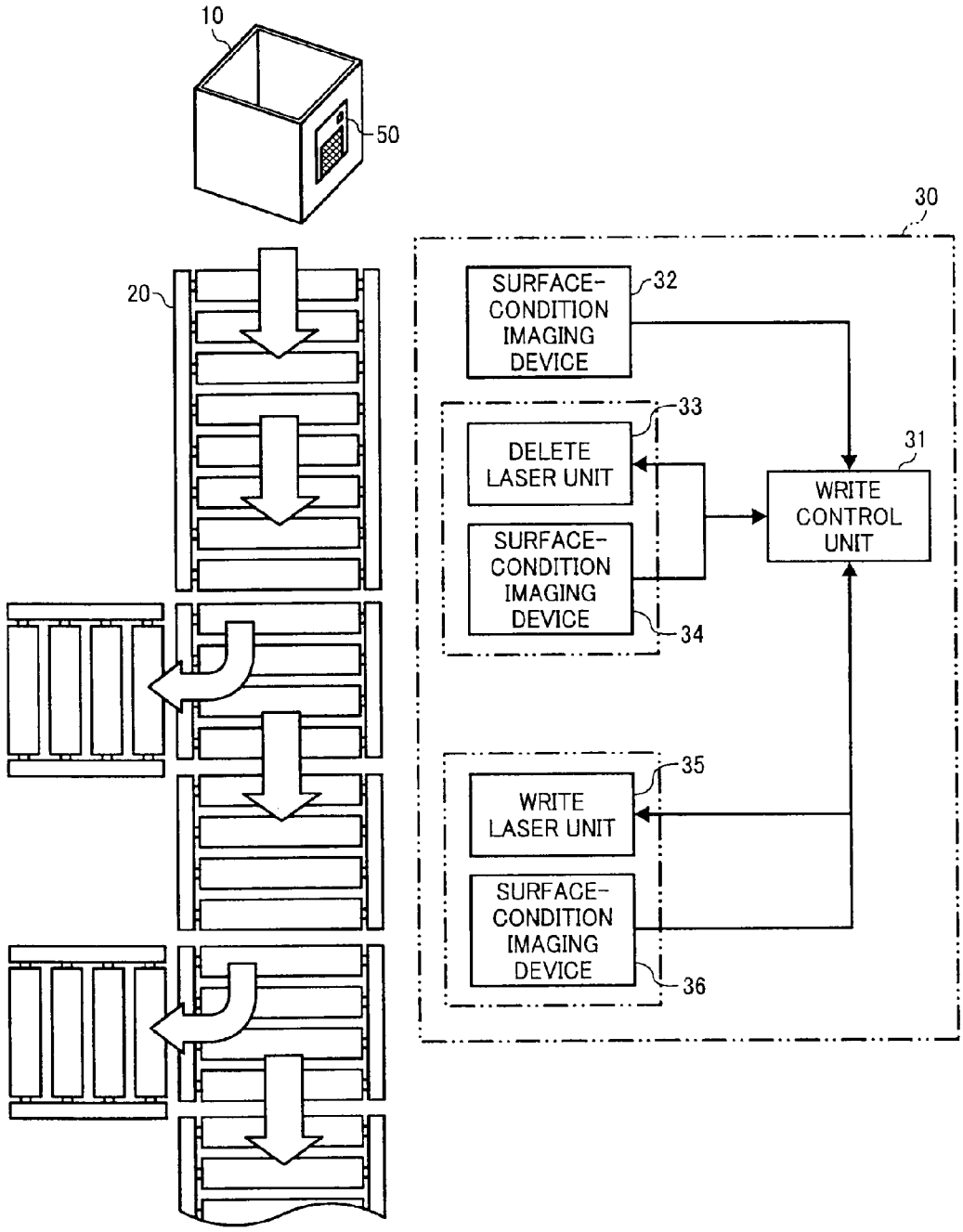
FIG. 1 is a schematic diagram of a system according to an embodiment of the present invention.
Figure 2:
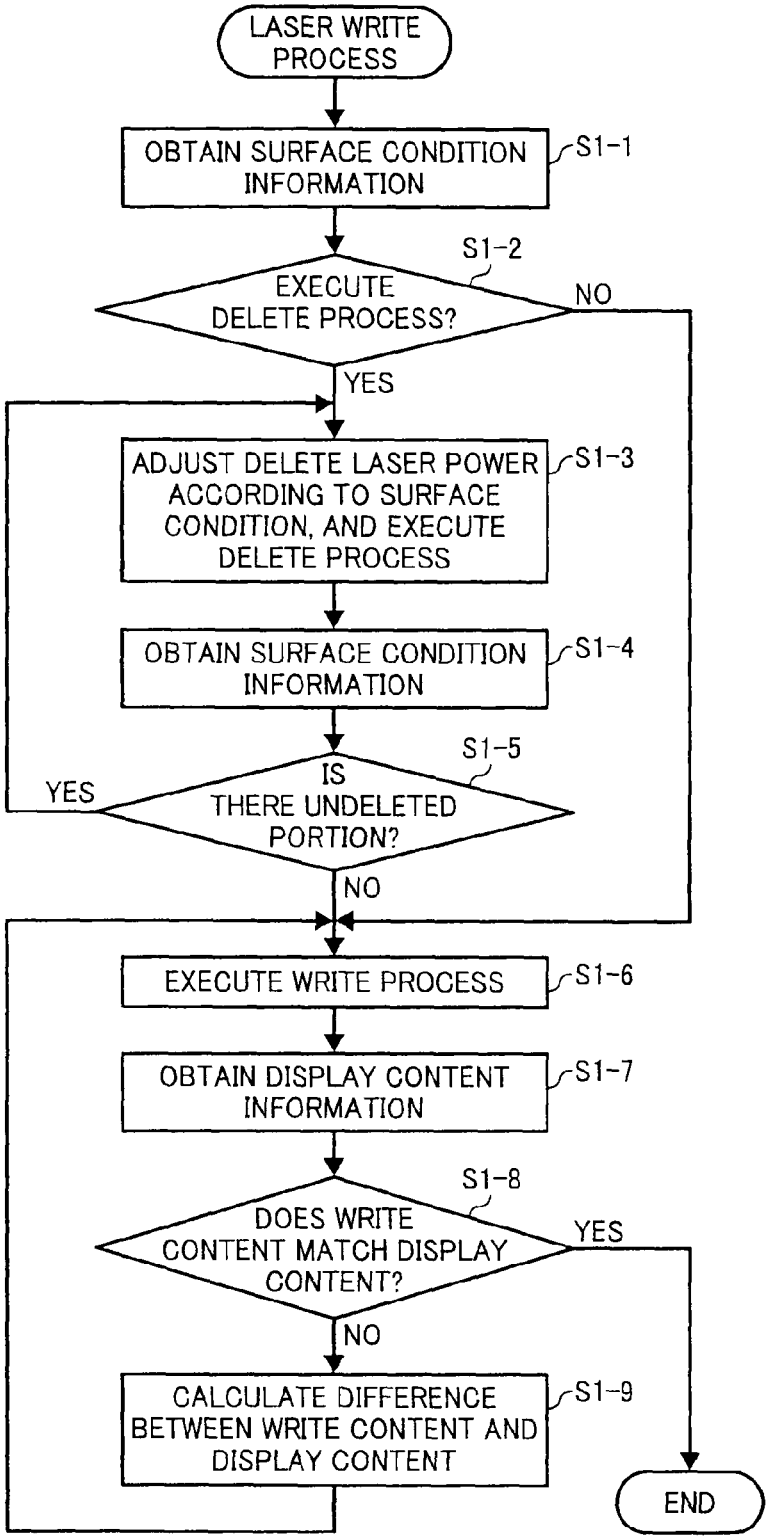
FIGS. 2 to 13 are flowcharts of a process procedure of a laser write process.

As shown in FIG. 1, a laser writing apparatus 30 as the laser rewriting system in the embodiment is arranged on the side of a conveying unit 20 as a transport unit on which a container 10 as an object to be managed is placed and carried. The laser writing apparatus 30 includes a write control unit 31, a surface-condition imaging device 32, an erase processing unit including a erase laser unit 33 and a surface-condition imaging device 34, and a write processing unit including a write laser unit 35 and a surface-condition imaging device 36. In the first embodiment, the surface-condition imaging device 32, the erase processing unit, and the write processing unit are arranged in this order from the upstream of the conveying unit 20.

The write control unit 31 has a central processing unit (CPU), a random access memory (RAM), a read only memory (ROM), and the like (not shown), and functions as a control unit. The write control unit 31 controls the erase laser unit 33 and the write laser unit 35 based on data supplied from the surface-condition imaging devices (32, 34, and 36). The write control unit 31 transmits or receives data via a delivery management server and a network (not shown).

The write control unit 31 transmits ID data of a two-dimensional code included in photographed image data to the delivery management server. The delivery management server includes a container-data storage unit that manages the container used for delivery. The content data to be written on a rewritable recording-medium 50 is stored in the container-data storage unit in association with the ID data corresponding to the rewritable recording-medium 50 attached to the container. The deliver management server provides the content data corresponding to the ID data obtained from the write control unit 31 to the write control unit 31.

When having detected an unerased area or a writing error, the write control unit 31 controls a transport driving unit of the conveying unit 20 to control stop or a transport speed of the conveying unit on which the container 10 having the unerased area or the writing error is placed.

The surface-condition imaging devices (32, 34, and 36) photograph the surface of the rewritable recording-medium 50 attached to the container 10 on the conveying unit 20. In the first embodiment, the surface-condition imaging device 32 functions as a surface-condition-information obtaining unit, the surface-condition imaging device 34 functions as a detecting unit, and the surface-condition imaging device 36 functions as an image verifying unit. The surface-condition imaging devices (32, 34, and 36) supply the photographed image data to the write control unit 31. Accordingly, the write control unit 31 can detect an initial state of the surface of the rewritable recording-medium 50, erasing or writing state of characters, a state of an attached position using a position sensing marker on the rewritable recording-medium 50, a distance to the container 10, and the like, by using the received photographed image data.

The erase laser unit 33 functions as an erasing unit, and includes a erase laser source and an optical mechanical unit. A 40-watt $CO_2$ laser is used for the erase laser source. Because $CO_2$ laser beams (having a wavelength of 10.6 micrometers) are absorbed by a thermo-chromic film described later, heating for writing and erasing can be performed. The optical mechanical unit includes a galvanometer and mirrors fitted to the galvanometer. An image on the rewritable recording-medium 50 is erased by high-speed rotational scanning with laser beams output from the laser source by two mirrors in X-axis and Y-axis directions fitted to the galvanometer. The light intensity of the laser beams on the surface of the rewritable recording-medium 50 is adjusted by the erase laser source and the optical mechanical unit so that the surface temperature becomes erasing temperature of from 130° C. to 170° C., thereby erasing an image (including characters, bar code, and the like).

The write laser unit 35 functions as a write laser applying unit, and includes a write laser source and an optical mechanical unit. The 40-watt $CO_2$ laser is used for the write laser source as in the erase laser source. The optical mechanical unit includes the galvanometer and the mirrors fitted to the galvanometer, as in the optical mechanical unit of the erase laser unit 33. The optical mechanical unit is used for forming an image on the rewritable recording-medium 50. The light intensity of the laser beams on the surface of the rewritable recording-medium is adjusted by the write laser source and the optical mechanical unit so that the surface temperature becomes writing temperature of 180° C., thereby effecting color development.

The rewritable recording-medium 50 as a rewritable display medium attached to a predetermined side of the container 10 is explained next.

The rewritable recording-medium 50 in the first embodiment is, for example, A4-size paper. The rewritable recording-medium 50 includes four layers of a protective layer, a recording layer made of the thermo-chromic film, a base layer, and a back coating layer in this order from the surface towards the depth direction. The rewritable recording-medium 50 is formed to have flexibility and a strength characteristic to some extent, and can be used repeatedly. A rewritable display area as a rewritable rewritable display area and a position sensing marker are provided in a part of the rewritable recording-medium 50.

The rewritable display area includes a rewritable thermal recording medium such as the thermo-chromic film. The rewritable thermal recording medium has a mode in which transparency changes reversibly depending on the temperature, and a mode in which tone changes reversibly depending on the temperature. In the first embodiment, the thermo-chromic film as the rewritable recording medium of the mode in which the tone changes reversibly depending on the temperature is used, which includes a leuco dye and a developer in the recording layer, to realize a rewritable characteristic. That is, the color development is effected by heating the recording medium from an achromatized state to a melting point or higher (for example, about 180° C.) and quenching the recording medium from a molten state where the leuco dye and the developer are mixed. In this case, the leuco dye and the developer agglutinate while being coupled to form a state where the leuco dye and the developer assemble regularly to some extent, thereby fixing the color developed state. On the other hand, achromatization is effected by reheating the recording medium to a temperature at which the color developed state is not melted (for example, 130° C. to 170° C.). In this case, the assembled state of color development collapses, and the developer is singly crystallized and separated, thereby causing an achromatized state.

The leuco dye is a colorless or light-colored dye precursor and can be appropriately selected from commonly known dye precursors without any particular limitation. A fluoran or phthalide leuco dye is particularly preferable in view of color development and achromatic characteristics, coloration, and preservability. These leuco dyes can be used singly or mixed together. Layers that develop color in different tones can be laminated to obtain multi-color or full color images. Alternatively, a rewritable thermal recording medium having such a configuration that characters and images written on the rewritable recording-medium 50 are erased naturally at a room temperature or due to sunlight can be used.

The position sensing marker is provided on the rewritable recording-medium 50, and is used to identify the position or the height of the rewritable recording-medium 50. In the first embodiment, the write control unit 31 detects the distance to the container 10 or a vibrational state of the container 10 by using the position sensing marker.

A process procedure when a laser write process is executed by the laser writing apparatus 30 having such a configuration is explained next with reference to FIG. 2. The laser write process is performed, for example, when packing of a product to be shipped is completed and delivery information of the product is written on the rewritable recording-medium 50 on which packing instruction data is recorded. A two-dimensional code including an identifier for identifying the container 10, to which the rewritable recording-medium 50 is attached, is displayed in a rewritable area of the rewritable recording-medium 50. The container 10 is placed on the conveying unit 20 and sequentially carried by the conveying unit 20.

The write control unit 31 obtains surface condition information (Step S1-1). Specifically, when having detected the container 10, the surface-condition imaging device 32 photographs the surface (rewritable display area) of the rewritable recording-medium 50 attached to the container 10 and transmits the photographed image data to the write control unit 31. The write control unit 31 obtains the two-dimensional code from the obtained photographed image data to obtain the ID data for identifying the rewritable recording-medium 50.

The write control unit 31 determines whether the erase process is required (Step S1-2). The write control unit 31 determines whether there is writing in the photographed image data obtained from the surface-condition imaging device 32. Specifically, the write control unit 31 obtains image data of an initial state of the rewritable recording-medium 50 from a predetermined memory. The write control unit 31 compares the photographed image data obtained from the surface-condition imaging device 32 with the image data of the initial state. When there is a part in which the photographed image data and the image data of the initial state do not match each other, the write control unit 31 detects the writing and determines that the erase process is required.

When it is determined that the erase process is required (YES at Step S1-2), the write control unit 31 adjusts erase laser power according to the surface condition to execute the erase process (Step S1-3). In this case, the write control unit 31 instructs the transport driving unit to control the transport speed of the conveying unit 20 within an erasable speed range. The write control unit 31 controls the erase laser unit 33 to apply the laser beams for erasing. In this case, the write control unit 31 adjusts the erase laser power based on the obtained photographed image data. Specifically, the write control unit 31 identify a part in which the photographed image data and the image data of the initial state do not match each other, to set the erase laser power according to the size or density of the part. The write control unit 31 notifies the erase laser unit 33 of the setting information. The erase laser unit 33 applies the erase laser beams to the rewritable area by using the erase laser source and the optical mechanical unit, and sets the surface temperature to the erasing temperature, thereby erasing an image (characters, bar code, or the like).

After the erase process performed by the erase laser unit 33, the write control unit 31 obtains the surface condition information again (Step S1-4). Specifically, the surface-condition imaging device 34 photographs the rewritable display area, and transmits the photographed image data obtained by the photographing to the write control unit 31.

In this case, the write control unit 31 determines whether there is unerased area (Step S1-5). Specifically, the write control unit 31 compares the photographed image data obtained from the surface-condition imaging device 34 with the image data of the initial state of the rewritable recording-medium 50. When there is a part in which the photographed image data and the image data of the initial state do not match each other, the write control unit 31 determines that there is unerased area.

When there is the unerased area (YES at Step S1-5), the write control unit 31 adjusts the erase laser power according to the surface condition, to execute the erase process (Step S1-3). Also, in this case, the write control unit 31 identifies the part in which the photographed image data and the image data of the initial state do not match each other, and sets the erase laser power according to the size or density of the part. The write control unit 31 notifies the erase laser unit 33 of the setting information, and the erase laser unit 33 executes the erase process. The process from Steps S1-3 to S1-5 is repeated.

When it is determined that there is the unerased area, the write control unit 31 can control the transport driving unit of the conveying unit 20, to guide the container 10, to which the rewritable recording-medium 50 is attached, to another transport route to execute a re-erase process.

When it is determined that the erase process is not required (NO at Step S1-2) or there is no unerased area (NO at Step S1-5), the write control unit 31 executes the write process (Step S1-6). The write control unit 31 transmits a control signal to the transport driving unit to control the transport speed of the conveying unit 20 within a writable speed range. Further, the write control unit 31 transmits the ID data of the two-dimensional code included in the photographed image data to the delivery management server. The write control unit 31 then obtains the content data corresponding to the ID data from the delivery management server.

The write control unit 31 calculates a laser applying area and a laser beam intensity based on the transport speed of the conveying unit 20. That is, the write control unit 31 determines a scanning range of the laser beams based on the transport speed and calculates the laser beam intensity so that the surface temperature becomes a writing temperature.

The write control unit 31 generates the data for drawing (drawing image data) on the rewritable recording-medium 50 based on the content data obtained from the delivery management server. Specifically, the write control unit 31 determines a scanning track of the laser application based on the content data and the transport speed of the conveying unit 20. The write control unit 31 transmits the drawing image data to the write laser unit 35 and controls so that the laser application for writing is performed. Accordingly, the write laser unit 35 applies the write laser beams to the rewritable area by using the write laser source and the optical mechanical unit, and sets the surface temperature to the writing temperature to draw an image.

The write control unit 31 obtains display content information (Step S1-7). Specifically, the surface-condition imaging device 36 photographs the rewritable display area and transmits the photographed image data obtained by photographing to the write control unit 31.

The write control unit 31 determines whether the write content and the display content match each other (Step S1-8). Specifically, the write control unit 31 compares the drawing image data (write content) to be drawn by using the write laser unit 35 with the photographed image data (display content) obtained from the surface-condition imaging device 36.

When the write content does not match the display content (NO at Step S1-8), the write control unit 31 calculates a difference between the write content and the display content (Step S1-9). Specifically, the write control unit 31 generates content data to be added and written from the difference between the drawing image data and the photographed image data.

The write control unit 31 executes the write process again (Step S1-6). In this case, the write control unit 31 controls the transport driving unit of the conveying unit 20 to transport the container to a position where the write process is executed with respect to the rewritable recording-medium 50. In this case, the write process is executed based on the content data generated at Step S1-9. The process from Steps S1-6 to S1-9 is repeated.

On the other hand, when the write content matches the display content (YES at Step S1-8), the write control unit 31 finishes the laser write process. The container 10 attached with the rewritable recording-medium, on which the new image is displayed, is carried to the next process by the conveying unit 20.

According to the first embodiment, the following effects can be obtained.

(1) In the first embodiment, the write control unit 31 obtains the surface condition information (Step S1-1). When it is determined that the erase process is required based on the surface condition information (YES at Step S1-2), the write control unit 31 adjusts the erase laser power according to the surface condition to execute the erase process (Step S1-3). Accordingly, the write control unit 31 can apply the erase laser beams according to the image. Accordingly, the image displayed on the rewritable recording-medium 50 can be efficiently erased.

(2) In the first embodiment, after the erase process performed by the erase laser unit 33, the write control unit 31 obtains the surface condition information again (Step S1-4) to determine whether there is the unerased area (Step S1-5). When there is the unerased area (YES at Step S1-5), the write control unit 31 adjusts the erase laser power according to the surface condition to execute the erase process (Step S1-3). The write control unit 31 notifies the erase laser unit 33 of the setting information, and the erase laser unit 33 executes the erase process. The process from Steps S1-3 to S1-5 is repeated. Accordingly, because the write process can be executed in a state having no unerased area, the image to be displayed by the write process can be displayed more reliably.

(3) In the first embodiment, before performing the erase process (Step S1-3), the write control unit 31 determines whether there is the unerased area (Step S1-5). Accordingly, when the rewritable recording-medium 50 having a configuration in which an image is naturally erased is used, the erase process can be omitted if an image is naturally erased.

(4) In the first embodiment, when having executed the write process (Step S1-6), the write control unit 31 obtains the display content information (Step S1-7), and determines whether the write content and the display content match each other (Step S1-8). When the write content does not match the display content (NO at Step S1-8), the write control unit 31 calculates a difference between the write content and the display content (Step S1-9), and re-executes the write process (Step S1-6). On the other hand, when the write content matches the display content (YES at Step S1-8), the write control unit 31 finishes the laser write process. Because the write control unit 31 executes the write process again only with respect to an insufficient part so that the part is displayed, the write content to be displayed can be displayed efficiently and more reliably.

Figure 3:
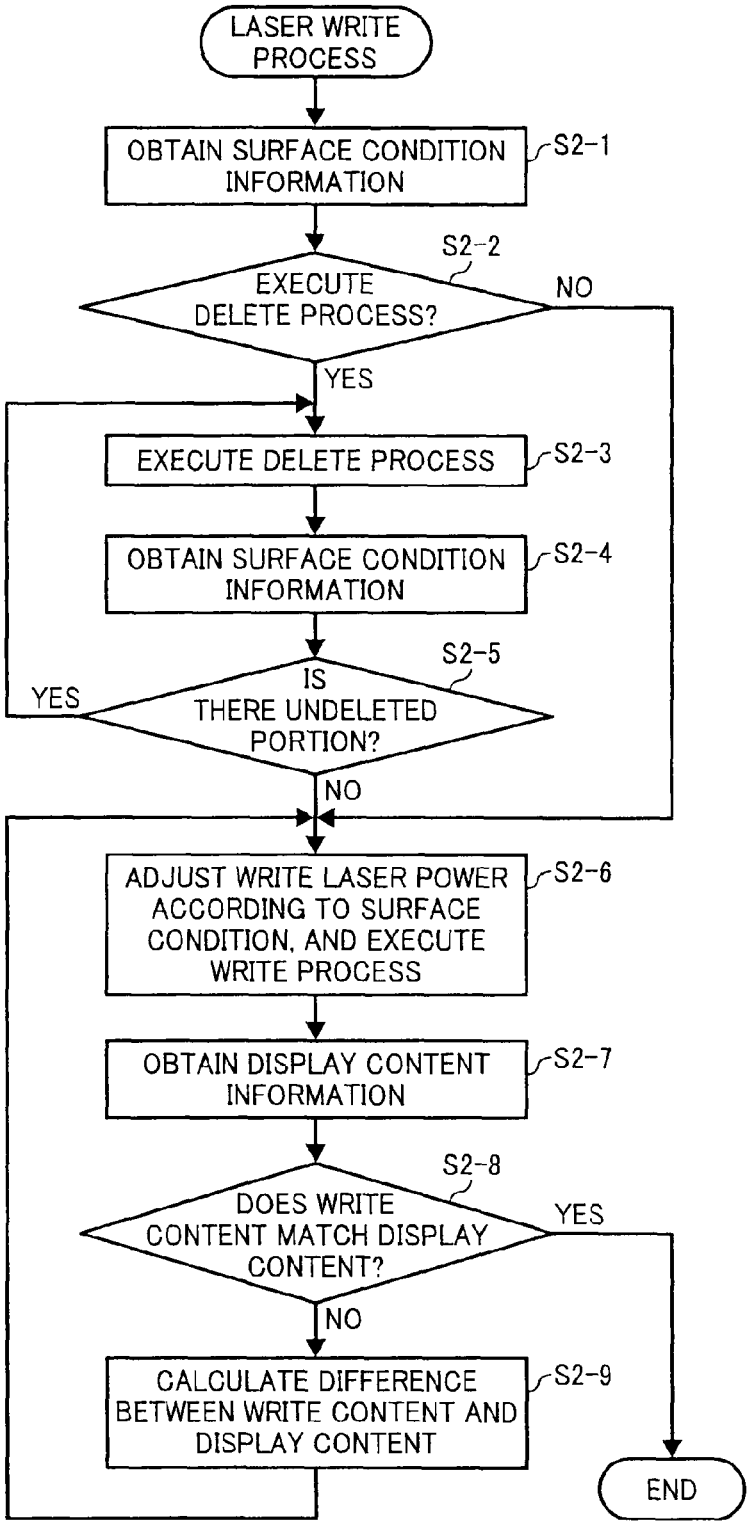

A second embodiment of the present invention is explained with reference to FIG. 3. In the embodiments explained below, like reference numerals refer to like parts as in the first embodiment, and detailed explanations thereof will be omitted. In the second embodiment, the erase process or the write process is different from that of the first embodiment.

Also in the second embodiment, the laser writing apparatus 30 having the same configuration as that in the first embodiment is used. Also in the second embodiment, the container 10 is carried by the conveying unit 20. When the surface-condition imaging device 32 detects the container 10, the write control unit 31 obtains the surface condition information as at Step S1-1 in the first embodiment (Step S2-1). The write control unit 31 determines whether the erase process is required based on the surface condition information (Step S2-2). When it is determined that the erase process is required (YES at Step S2-2), the write control unit 31 executes the erase process (Step S2-3). Specifically, the write control unit 31 instructs the transport driving unit to control the transport speed of the conveying unit 20 within the erasable speed range. The write control unit 31 controls the erase laser unit to perform laser application for erasing. In the second embodiment, a pre-set constant is used as the erase laser power. The erase laser unit 33 erases an image by applying the erase laser beams.

After the erase process is performed by the erase laser unit 33, the write control unit 31 obtains the surface condition information again as at Step S1-4 (Step S2-4). The write control unit 31 determines whether there is unerased area as at Step S1-5 (Step S2-5). When there is the unerased area (YES at Step S2-5), the write control unit 31 executes the erase process again (Step S2-3). The pre-set constant is also used for the erase laser power.

On the other hand, when it is determined that the erase process is not required (NO at Step S2-2) or there is no unerased area (NO at Step S2-5), the write control unit 31 adjusts the write laser power according to the surface condition and executes the write process (Step S2-6). The write control unit 31 first controls the transport speed of the conveying unit 20 within the writable speed range. The write control unit 31 transmits the ID data of a bar code included in the photographed image data to the delivery management server. The write control unit 31 obtains the content data corresponding to the ID data from the delivery management server.

On the other hand, the write control unit 31 calculates the laser applying area and the laser beam intensity based on the transport speed of the conveying unit 20. That is, the write control unit 31 determines the scanning range of the laser beams based on the transport speed and calculates the laser beam intensity such that the surface temperature of the rewritable recording-medium becomes the writing temperature.

The write control unit 31 generates the data (drawing image data) for drawing on the rewritable recording-medium 50 based on the content data obtained from the delivery management server. The write control unit 31 transmits the drawing image data to the write laser unit 35, and controls laser application for writing to apply the write laser beams, thereby drawing an image.

The write control unit 31 obtains the display content information as at Step S1-7 (Step S2-7). The write control unit 31 determines whether the write content and the display content match each other as at Step S1-8 (Step S2-8). When the write content does not match the display content (NO at Step S2-8), the write control unit 31 calculates a difference between the write content and the display content as at Step S1-9 (Step S2-9). The write control unit 31 repeatedly executes the process from Steps S2-6 to S2-9. On the other hand, when the write content matches the display content (YES at Step S2-8), the write control unit 31 finishes the laser write process.

According to the second embodiment, the effect described below can be obtained in addition to the effects of (2) to (4) of the first embodiment.

(5) In the second embodiment, the write control unit 31 obtains the surface condition information (Step S2-1). The write control unit 31 adjusts the write laser power according to the surface condition and executes the write process (Step S2-6). Accordingly, because the write control unit 31 can apply the write laser beams according to the surface condition of the rewritable recording-medium 50, laser writing appropriate for the surface condition of the rewritable recording-medium 50 at the time of writing can be efficiently performed.

Figure 4:
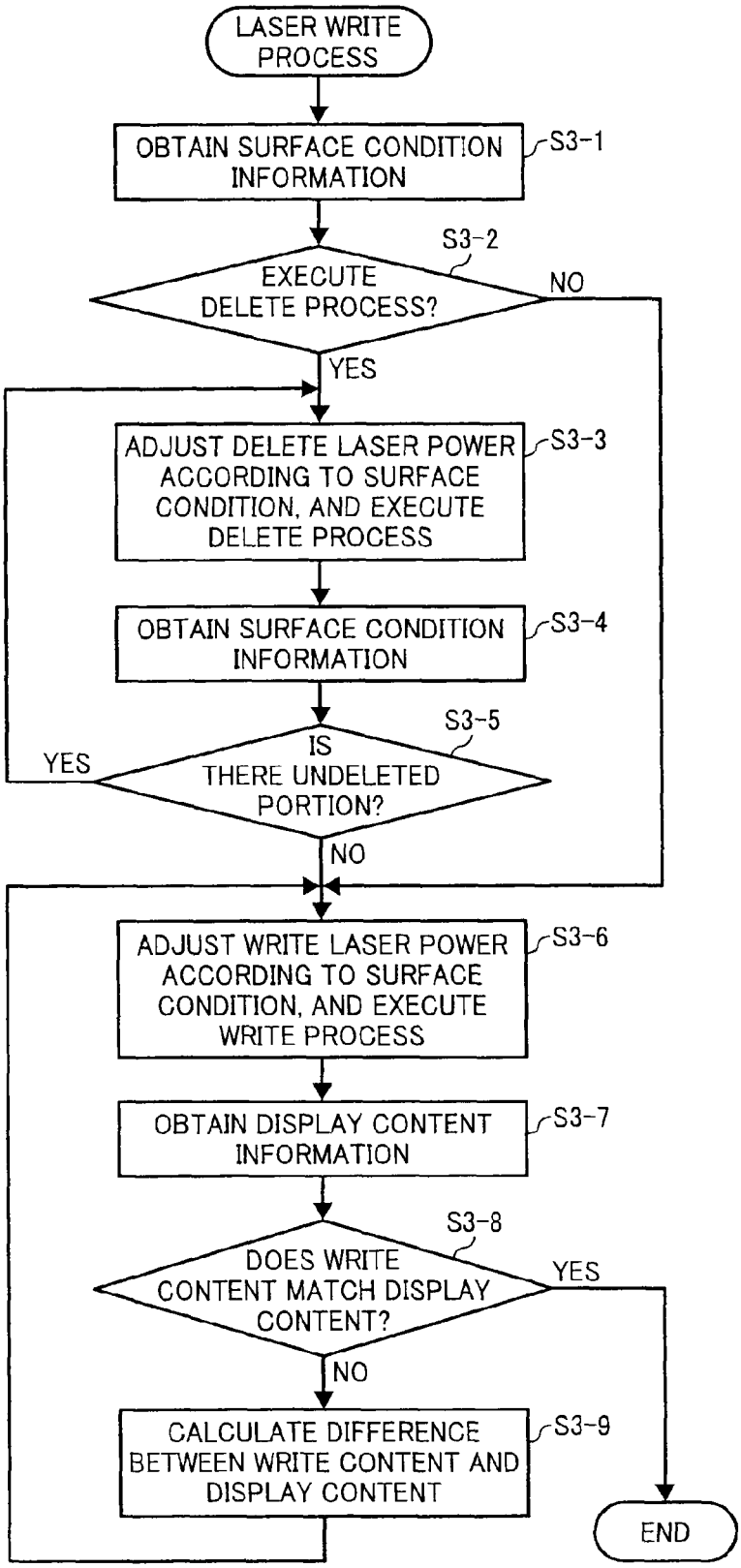

A third embodiment of the present invention is explained with reference to FIG. 4. In the third embodiment, the erase process or the write process is different from that in the first and second embodiments.

Also in the third embodiment, the laser writing apparatus 30 having the same configuration as that in the first embodiment is used. Also in the second embodiment, the container 10 is carried by the conveying unit 20. When the surface-condition imaging device 32 detects the container 10, the write control unit 31 obtains the surface condition information as at Step S1-1 in the first embodiment (Step S3-1). The write control unit 31 determines whether the erase process is required based on the surface condition information (Step S3-2). When it is determined that the erase process is required (YES at Step S3-2), the write control unit 31 executes the erase process as at Step S1-3 (Step S3-3).

After the erase process is performed by the erase laser unit 33, the write control unit 31 obtains the surface condition information again as at Step S1-4 (Step S3-4). The write control unit 31 determines whether there is unerased area as at Step S1-5 (Step S3-5). When there is the unerased area (YES at Step S3-5), the write control unit 31 executes the erase process again (Step S3-3).

On the other hand, when it is determined that the erase process is not required (NO at Step S3-2) or there is no unerased area (NO at Step S3-5), the write control unit 31 adjusts the write laser power according to the surface condition and executes the write process (Step S3-6). When the write control unit 31 finishes the write process, the write control unit 31 obtains the display content information as at Step S1-7 (Step S3-7). The write control unit 31 determines whether the write content and the display content match each other as at Step S1-8 (Step S3-8).

When the write content does not match the display content (NO at Step S3-8), the write control unit 31 calculates a difference between the write content and the display content as at Step S1-9 (Step S3-9). The write control unit 31 then repeatedly executes the process from Steps S3-6 to S3-9. On the other hand, when the write content matches the display content (YES at Step S3-8), the write control unit 31 finishes the laser write process.

According to the second embodiment, the same effects as those in (1) to (5) in the above embodiments can be obtained.

Figure 5:
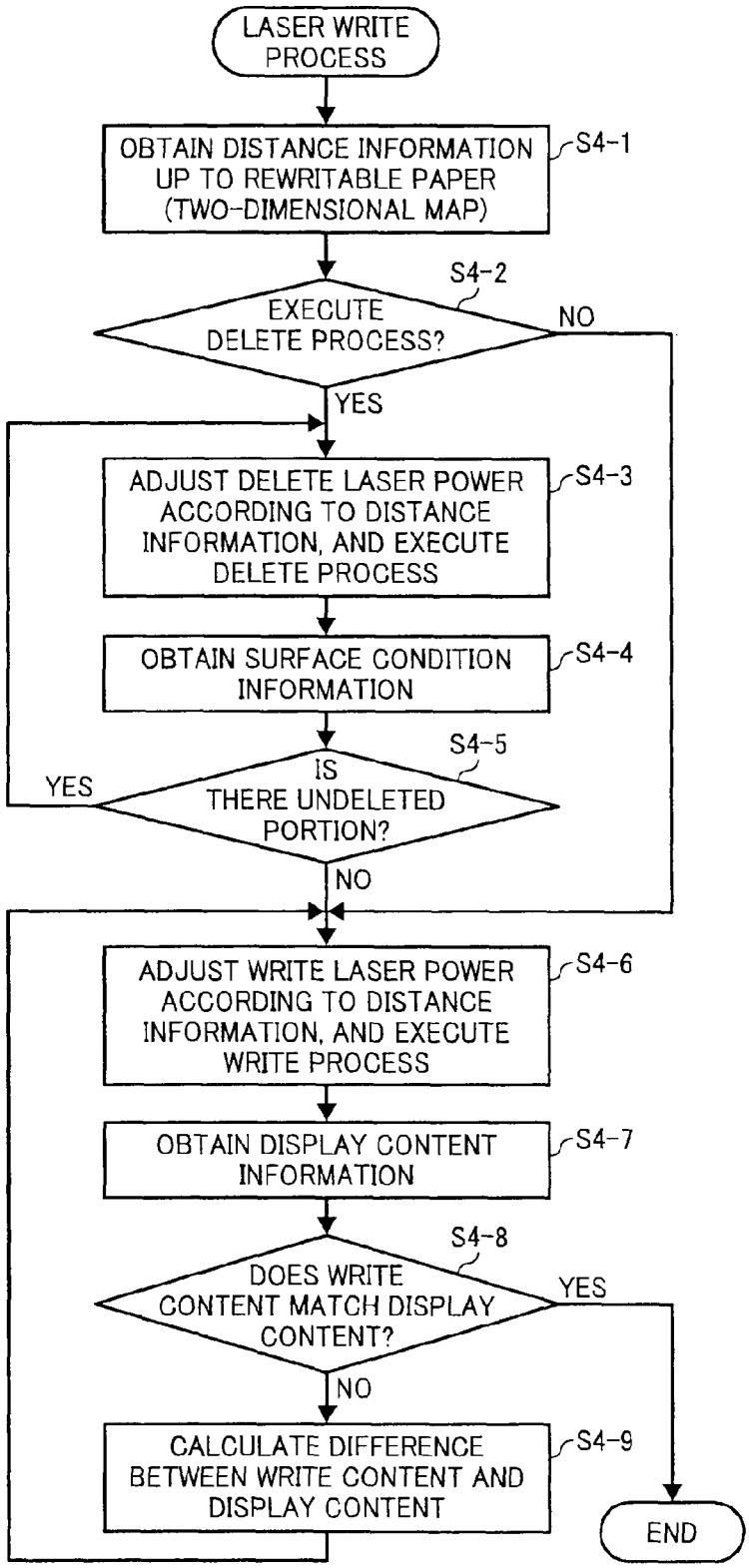

A fourth embodiment of the present invention is explained with reference to FIG. 5. In the fourth embodiment, the laser power is adjusted based on distance information up to the rewritable recording-medium 50, which is different from the first to the third embodiments.

Also in the fourth embodiment, the laser writing apparatus 30 having the same configuration as that in the first embodiment is used. The write control unit 31 in the laser writing apparatus 30 according to the fourth embodiment stores data for calculating a distance to the rewritable recording-medium 50. Specifically, the distance is calculated from a focal distance by using a well-known auto focus technique.

Also in the fourth embodiment, the container 10 is carried by the conveying unit 20. When having detected the container 10, the surface-condition imaging device 32 photographs the surface (rewritable display area) of the rewritable recording-medium 50 on the container 10. In the fourth embodiment, the surface-condition imaging device 32 photographs the surface of the rewritable recording-medium 50 several times by shifting a focal point. The surface-condition imaging device 32 transmits a plurality of photographed image data to the write control unit 31.

The write control unit 31 obtains the surface condition information of the rewritable recording-medium 50 and the distance information up to the rewritable recording-medium 50 (Step S4-1). The write control unit 31 obtains the surface condition information from the obtained photographed image data as at Step S1-2. Also in the fourth embodiment, the write control unit 31 generates a two-dimensional map of distance in the respective parts of the rewritable recording-medium 50 from the focal distance calculated from the photographed image data.

The write control unit 31 determines whether the erase process is required based on the obtained image data as at Step S1-2 (Step S4-2). When it is determined that the erase process is required (YES at Step S4-2), the write control unit 31 adjusts the erase laser power according to the obtained distance information to execute the erase process (Step S4-3). Specifically, the write control unit 31 controls the erase laser unit 33 to perform laser application for erasing, thereby erasing an image.

The write control unit 31 obtains the surface condition information again as at Step S1-4 (Step S4-4). The write control unit 31 determines whether there is unerased area as at Step S1-5 (Step S4-5). When there is the unerased area (YES at Step S4-5), the write control unit 31 executes the erase process again (Step S4-3).

On the other hand, when it is determined that the erase process is not required (NO at Step S4-2) or there is no unerased area (NO at Step S4-5), the write control unit 31 adjusts the write laser power according to the distance information to execute the write process (Step S4-6). The write control unit 31 controls the transport speed of the conveying unit 20 within the writable speed range, determines the scanning range of the laser beams, obtains the content data associated with the ID data from the delivery management server, and generates the drawing image data from the content data, as at Step S1-6. The write control unit 31 calculates the laser beam intensity according to the distance information. The write control unit 31 controls the write laser unit 35 based on the drawing image data and the laser beam intensity, to apply the write laser beams, thereby drawing an image.

The write control unit 31 obtains the display content information as at Step S1-7 (Step S4-7). The write control unit 31 determines whether the write content and the display content match each other as at Step S1-8 (Step S4-8). When the write content does not match the display content (NO at Step S4-8), the write control unit 31 calculates a difference between the write content and the display content as at Step S1-9 (Step S4-9). The write control unit 31 repeatedly executes the process from Steps S4-6 to S4-9. On the other hand, when the write content matches the display content (YES at Step S4-8), the write control unit 31 finishes the laser write process.

According to the fourth embodiment, the effect described below can be obtained in addition to the effects of (1) to (5) of the above embodiments.

(6) In the fourth embodiment, the write control unit 31 obtains the distance information to the rewritable recording-medium 50 (Step S4-1). The write control unit 31 calculates the laser beam intensity according to the distance information. The write control unit 31 controls the write laser unit 35 according to the drawing image data and the beam laser intensity, to execute the write process (Step S4-6). For example, a curved or inclined state in the rewritable recording-medium 50 can be ascertained by generating a two-dimensional map of distance, when there is a curvature (curved surface) on the rewritable recording-medium 50, or when the rewritable recording-medium 50 is fitted with an inclination or the container 10 is carried in an inclined state. In this case, by adjusting the energy level, taking the curvature and the inclination into consideration, deterioration of the rewritable display medium due to strong application of laser beams and insufficient display of the image due to weak application of laser beams can be avoided.

Figure 6:
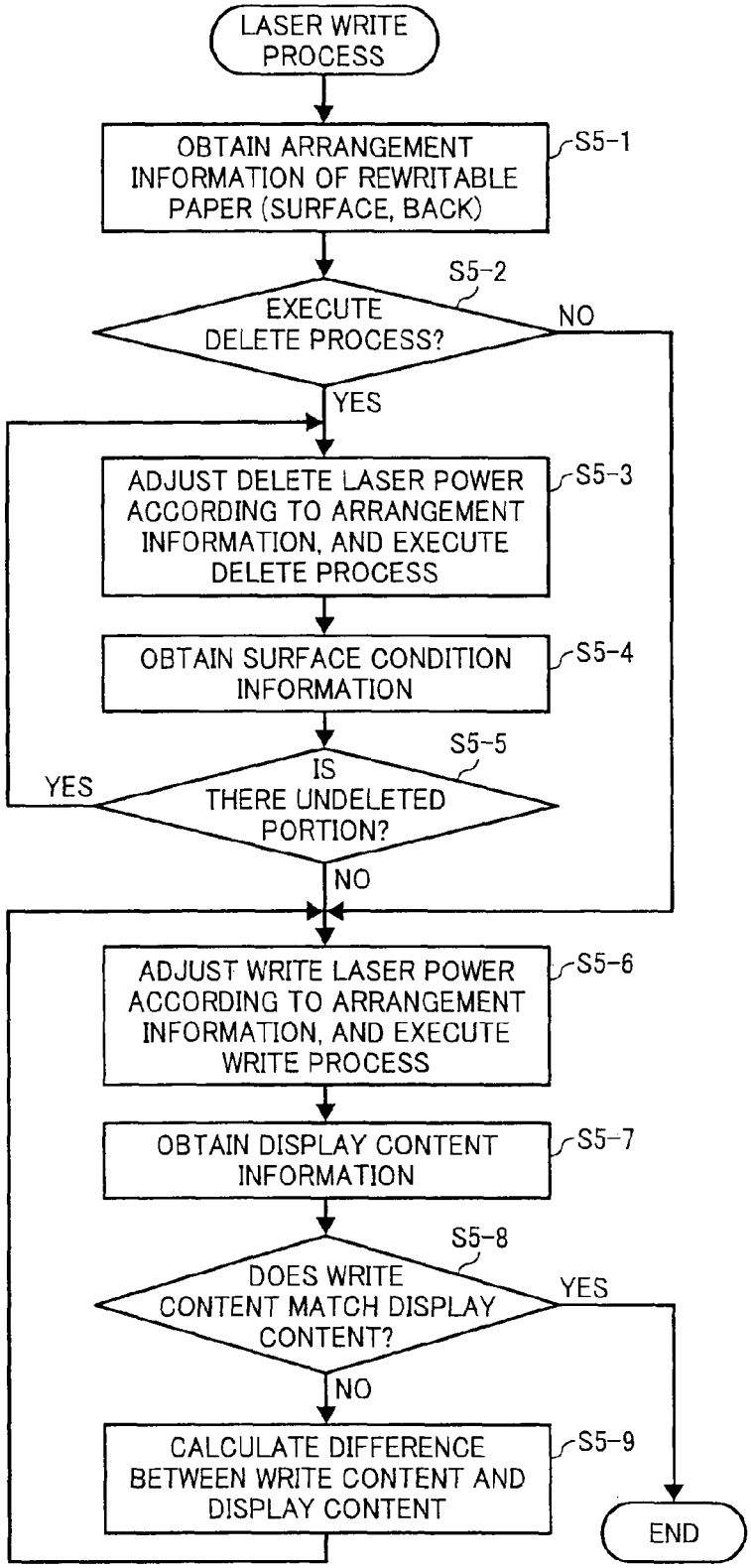

A fifth embodiment of the present invention is explained next with reference to FIG. 6. In the fifth embodiment, the laser power is adjusted based on information on an arrangement of the rewritable recording-medium 50, instead of using the distance information in the fourth embodiment.

Also in the fifth embodiment, the laser writing apparatus 30 having the same configuration as that in the first embodiment is used. The surface-condition imaging device 32 in the laser writing apparatus 30 in the fifth embodiment obtains the information on the arrangement indicating whether the rewritable recording-medium 50 is attached to one side or both sides of the container 10. Specifically, a plurality of mirrors (not shown) is provided near the surface-condition imaging device (32, 34, and 36) on the conveying unit 20. The surface-condition imaging device (32, 34, and 36) obtains the photographed image data of the rewritable recording-medium 50 attached to the other side of the opposite surface via the mirrors. The surface-condition imaging device (32, 34, and 36) supplies the obtained photographed image data to the write control unit 31. Upon storing the image data of the rewritable initial state, the write control unit 31 compares the supplied photographed image data with the respective image data of the initial state to obtain the information on the arrangement indicating whether the rewritable recording-medium 50 is attached to one side or both sides.

The mirrors (not shown) are also provided near the erase laser unit 33 and the write laser unit 35. The erase laser unit 33 and the write laser unit 35 can apply the laser beams not only to the rewritable recording-medium 50 attached to the opposite surface but also to the rewritable recording-medium 50 attached to the other side of the opposite surface by using the mirrors.

Also in the fifth embodiment, the container 10 is carried by the conveying unit 20. When having detected the container 10, the surface-condition imaging device 32 photographs the both sides at a position where the rewritable recording-medium 50 is attached to the container 10. In the fifth embodiment, the surface-condition imaging device 32 photographs not only the surface opposite to the surface-condition imaging device 32 but also the other side by using the mirrors. Further, in the fifth embodiment, the surface-condition imaging device 32 photographs the surface of the rewritable recording-medium 50 several times by shifting the focal point. The surface-condition imaging device 32 transmits the photographed image data to the write control unit 31 together with the data for identifying the opposite surface or the other side thereof.

The write control unit 31 obtains the information on the arrangement of the rewritable recording-medium 50 (Step S5-1). Specifically, the write control unit 31 compares the obtained photographed image data with the image data of the initial state of the rewritable recording-medium 50. As a result of comparison, the write control unit 31 detects that the rewritable recording-medium 50 is provided on one side or on both sides of the surface-condition imaging device 32.

The write control unit 31 determines whether the erase process is required based on the obtained image data as at Step S1-2 (Step S5-2). When it is determined that the erase process is required (YES at Step S5-2), the write control unit 31 adjusts the erase laser power according to the obtained information on the arrangement to execute the erase process (Step S5-3). Specifically, the write control unit 31 adjusts the laser power so that the surface temperature of the rewritable recording-medium 50 requiring the erase process becomes the erasing temperature. When the erase process is required with respect to the rewritable recording-medium on the other side of the surface opposite to the erase laser unit 33, the write control unit 31 controls the erase laser unit 33 to apply the laser beams via the mirrors. When the erase process is required with respect to the both sides of the rewritable recording-medium 50, the write control unit 31 controls the erase laser unit 33 to apply the laser beams by adjusting the laser power suitable for the respective surfaces.

The write control unit 31 obtains the surface condition information again as at Step S1-4 (Step S5-4). The write control unit 31 determines whether there is unerased area as at Step S1-5 (Step S5-5). When there is the unerased area (YES at Step S5-5), the write control unit 31 executes the erase process again (Step S5-3).

On the other hand, when it is determined that the erase process is not required (NO at Step S5-2) or there is no unerased area (NO at Step S5-5), the write control unit 31 adjusts the write laser power according to the information on the arrangement to execute the write process (Step S5-6). The write control unit 31 controls the transport speed of the conveying unit 20 within the writable speed range, determines the scanning range of the laser beams, obtains the content data associated with the ID data from the delivery management server, and generates the drawing image data from the content data, as at Step S1-6. The write control unit 31 calculates the laser beam intensity according to the information on the arrangement. The write control unit 31 adjusts the laser power such that the surface temperature of the rewritable recording-medium 50 to be written becomes the writing temperature. The write control unit 31 controls the write laser unit 35 to apply the laser beams via the mirrors, when the write process is performed with respect to the rewritable recording-medium 50 on the opposite side of the surface opposite to the write laser unit 35. When the erase process is required to the both sides of the rewritable recording-medium 50, the write control unit 31 controls the write laser unit 35 to apply the laser beams by adjusting the laser power suitable for the respective surfaces. The write control unit 31 controls the write laser unit 35 based on the drawing image data and the laser beam intensity to apply the write laser beams, thereby drawing an image.

The write control unit 31 obtains the display content information as at Step S1-7 (Step S5-7). The write control unit 31 determines whether the write content and the display content match each other as at Step S1-8 (Step S5-8). When the write content does not match the display content (NO at Step S5-8), the write control unit 31 calculates a difference between the write content and the display content as at Step S1-9 (Step S5-9). The write control unit 31 repeatedly executes the process from Steps S5-6 to S5-9. On the other hand, when the write content matches the display content (YES at Step S5-8), the write control unit 31 finishes the laser write process.

According to the fifth embodiment, the effect described below can be obtained in addition to the effects of (1) to (5) in the above embodiments.

(7) In the fifth embodiment, the write control unit 31 obtains the information on the arrangement of the rewritable recording-medium 50 (Step S5-1). The write control unit 31 adjusts the erase laser power according to the obtained information on the arrangement to execute the erase process (Step S5-3). The write control unit 31 adjusts the write laser power according to the information on the arrangement to execute the write process (Step S5-6). Accordingly, the write control unit 31 can identify whether the rewritable recording-medium 50 attached to the container 10 is provided on one side or on both sides, and efficiently display an image suitable for the rewritable recording-medium 50.

Figure 7:
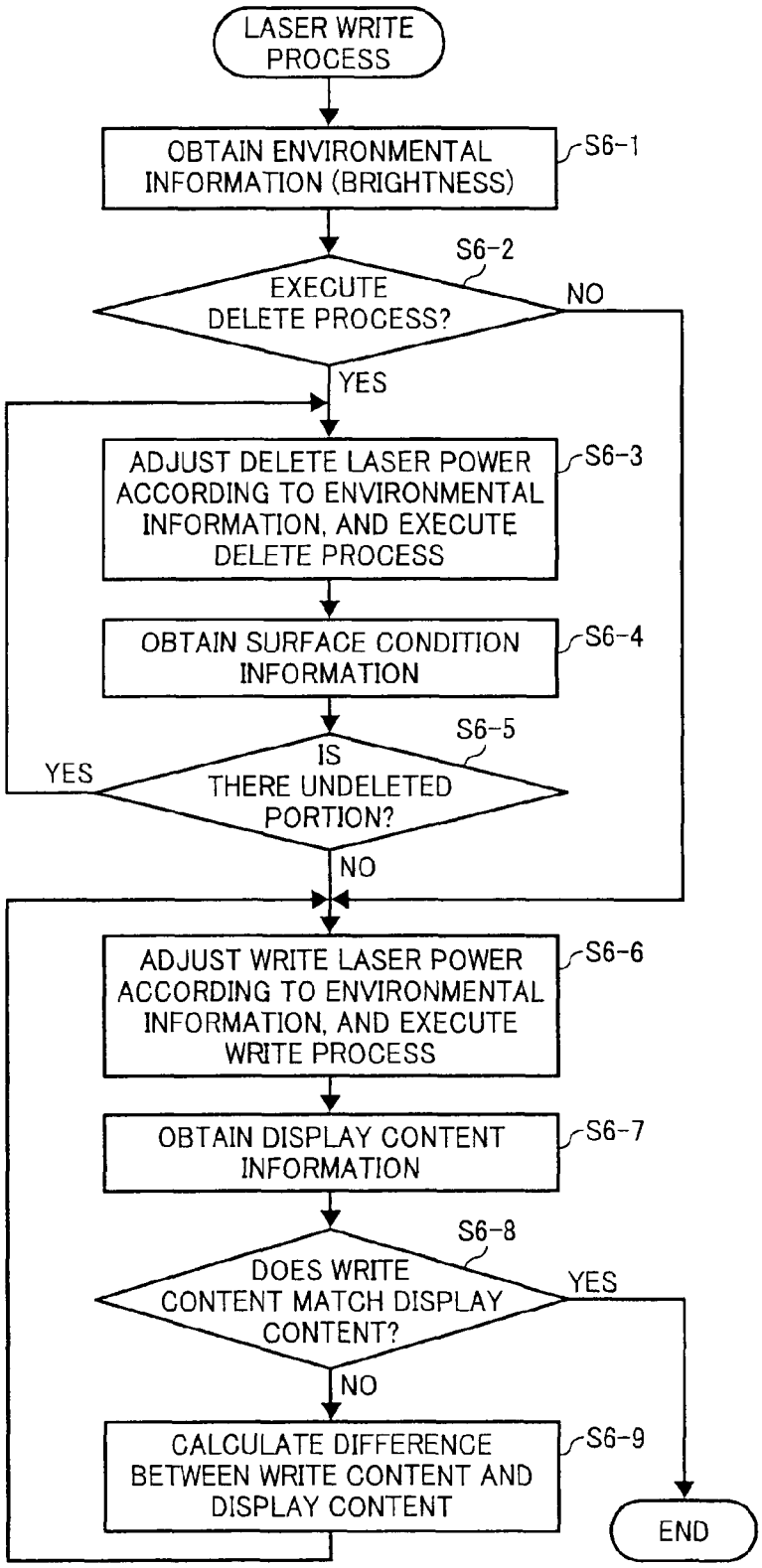

A sixth embodiment of the present invention is explained with reference to FIG. 7. In the sixth embodiment, the laser power is adjusted based on environmental information (brightness), which is different from the third embodiment.

Also in the sixth embodiment, the laser writing apparatus 30 having the same configuration as that in the first embodiment is used. The surface-condition imaging device 32 of the laser writing apparatus 30 in the sixth embodiment photographs the image data, also functions as an illuminometer, and transmits measured illuminance to the write control unit 31. The write control unit 31 stores data relating to the density corresponding to the respective illuminance levels.

Also in the sixth embodiment, the container 10 is carried by the conveying unit 20. When having detected the container 10, the surface-condition imaging device 32 photographs the surface of the rewritable recording-medium 50 on the container 10, and also measures the brightness (illuminance) in the photographing environment. The surface-condition imaging device 32 transmits the photographed image data and the measured illuminance data to the write control unit 31.

The write control unit 31 obtains the environmental information (Step S6-1). Specifically, the write control unit 31 obtains the illuminance data.

The write control unit 31 determines whether the erase process is required based on the obtained image data as at Step S1-2 (Step S6-2). When it is determined that the erase process is required (YES at Step S6-2), the write control unit 31 adjusts the erase laser power according to the obtained environmental information (illuminance) to execute the erase process (Step S6-3). Specifically, the write control unit 31 adjusts the focal point and the intensity of the erase laser, and controls the erase laser unit 33 to perform laser application for erasing, thereby erasing an image.

The write control unit 31 obtains the surface condition information as at Step S1-4 (Step S6-4). The write control unit 31 determines whether there is unerased area as at Step S1-5 (Step S6-5). When there is the unerased area (YES at Step S6-5), the write control unit 31 executes the erase process again (Step S6-3).

On the other hand, when it is determined that the erase process is not required (NO at Step S6-2) or there is no unerased area (NO at Step S6-5), the write control unit 31 adjusts the write laser power according to the environmental information to execute the write process (Step S6-6). The write control unit 31 controls the transport speed of the conveying unit 20 within the writable speed range, determines the scanning range of the laser beams, obtains the content data associated with the ID data from the delivery management server, and generates the drawing image data from the content data, as at Step S1-6. The write control unit 31 calculates the laser beam intensity so that the density corresponding the illuminance is obtained, based on the density data according to the environmental information (illuminance). The write control unit 31 controls the write laser unit 35 based on the drawing image data and the laser beam intensity to apply the write laser beams, thereby drawing an image.

The write control unit 31 obtains the display content information as at Step S1-7 (Step S6-7). The write control unit 31 determines whether the write content and the display content match each other as at Step S1-8 (Step S6-8). When the write content does not match the display content (NO at Step S6-8), the write control unit 31 calculates a difference between the write content and the display content as at Step S1-9 (Step S6-9). The write control unit 31 repeatedly executes the process from Steps S6-6 to S6-9. On the other hand, when the write content matches the display content (YES at Step S6-8), the write control unit 31 finishes the laser write process.

According to the sixth embodiment, the effect described below can be obtained in addition to the effects of (1) to (5) in the above embodiment.

(8) In the sixth embodiment, the write control unit 31 obtains the environmental information of the rewritable recording-medium 50 (Step S6-1). The write control unit 31 adjusts the erase laser power according to the obtained environmental information to execute the erase process (Step S6-3). Further, the write control unit 31 adjusts the write laser power according to the environmental information to execute the write process (Step S6-6). Accordingly, the write control unit 31 can apply the laser beams, taking the brightness around the rewritable recording-medium 50 into consideration. For example, characters and images having excellent visibility can be displayed by displaying a high density image in a bright place and a low density image in a dark place.

Figure 8:
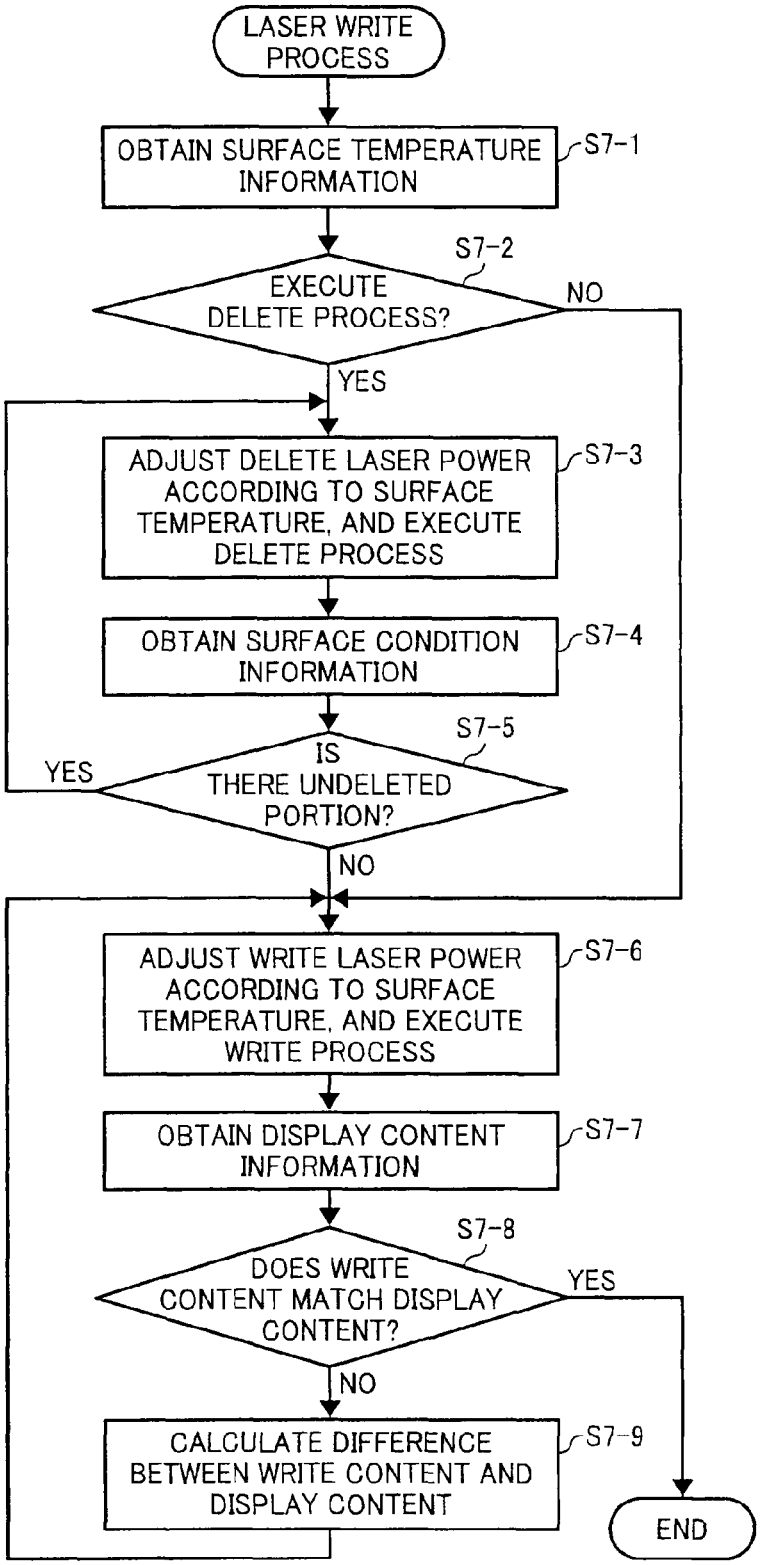

A seventh embodiment of the present invention is explained with reference to FIG. 8. In the seventh embodiment, the laser power is adjusted based on surface temperature information, which is different from the third embodiment.

Also in the seventh embodiment, the laser writing apparatus 30 having the same configuration as that in the first embodiment is used. The surface-condition imaging device 32 of the laser writing apparatus 30 in the seventh embodiment photographs the image data. The surface-condition imaging device 32 also functions as a thermography, to measure the temperature on the surface of the rewritable recording-medium 50, and transmit the measured temperature data to the write control unit 31.

Also in the seventh embodiment, the container 10 is carried by the conveying unit 20. When having detected the container 10, the surface-condition imaging device 32 photographs the surface of the rewritable recording-medium 50 on the container 10, and measures the surface temperature in the photographed rewritable display area. The surface-condition imaging device 32 transmits the photographed image data and the measured temperature data to the write control unit 31.

The write control unit 31 obtains the surface temperature information (Step S7-1). Specifically, the write control unit 31 generates a two-dimensional thermography based on the obtained temperature data.

The write control unit 31 determines whether the erase process is required based on the obtained photographed image data (Step S7-2). When it is determined that the erase process is required (YES at Step S7-2), the write control unit 31 adjusts the erase laser power according to the obtained surface temperature to execute the erase process (Step S7-3). Specifically, the write control unit 31 adjusts the focal point and the intensity of the erase laser so that the surface temperature of the rewritable recording-medium 50 becomes the erasing temperature. The write control unit 31 controls the erase laser unit 33 to perform laser application for erasing, thereby erasing an image.

The write control unit 31 obtains the surface condition information as at Step S1-4 (Step S7-4). The write control unit 31 determines whether there is unerased area as at Step S1-5 (Step S7-5). When there is the unerased area (YES at Step S7-5), the write control unit 31 executes the erase process again (Step S7-3).

On the other hand, when it is determined that the erase process is not required (NO at Step S7-2) or there is no unerased area (NO at Step S7-5), the write control unit 31 adjusts the write laser power according to the surface temperature information to execute the write process (Step S7-6). The write control unit 31 controls the transport speed of the conveying unit 20 within the writable speed range, determines the scanning range of the laser beams, obtains the content data associated with the ID data from the delivery management server, and generates the drawing image data from the content data, as at Step S1-6. The write control unit 31 calculates the laser beam intensity according to the surface temperature. The write control unit 31 controls the write laser unit 35 based on the drawing image data and the laser beam intensity to apply the write laser beams to draw an image.

The write control unit 31 obtains the display content information as at Step S1-7 (Step S7-7). The write control unit 31 determines whether the write content and the display content match each other as at Step S1-8 (Step S7-8). When the write content does not match the display content (NO at Step S7-8), the write control unit 31 calculates a difference between the write content and the display content as at Step S1-9 (Step S7-9). The write control unit 31 repeatedly executes the process from Steps S7-6 to S7-9. On the other hand, when the write content matches the display content (YES at Step S7-8), the write control unit 31 finishes the laser write process.

According to the seventh embodiment, the effect described below can be obtained in addition to the effects of (1) to (5) in the above embodiment.

(9) The write control unit 31 obtains the surface temperature information of the rewritable recording-medium 50 (Step S7-1). The write control unit 31 adjusts the erase laser power according to the obtained surface temperature to execute the erase process (Step S7-3). The write control unit 31 adjusts the write laser power according to the surface temperature information to execute the write process (Step S7-6). Accordingly, the laser application can be performed, taking the surface temperature of the rewritable recording-medium 50 into consideration. For example, when the surface temperature is high, by applying weaker laser beams, deterioration of the rewritable display medium can be avoided. For example, when the surface temperature is low, by applying stronger laser beams, the surface temperature of the rewritable recording-medium 50 is set to the writing temperature, thereby enabling to display an image more reliably.

Figure 9:
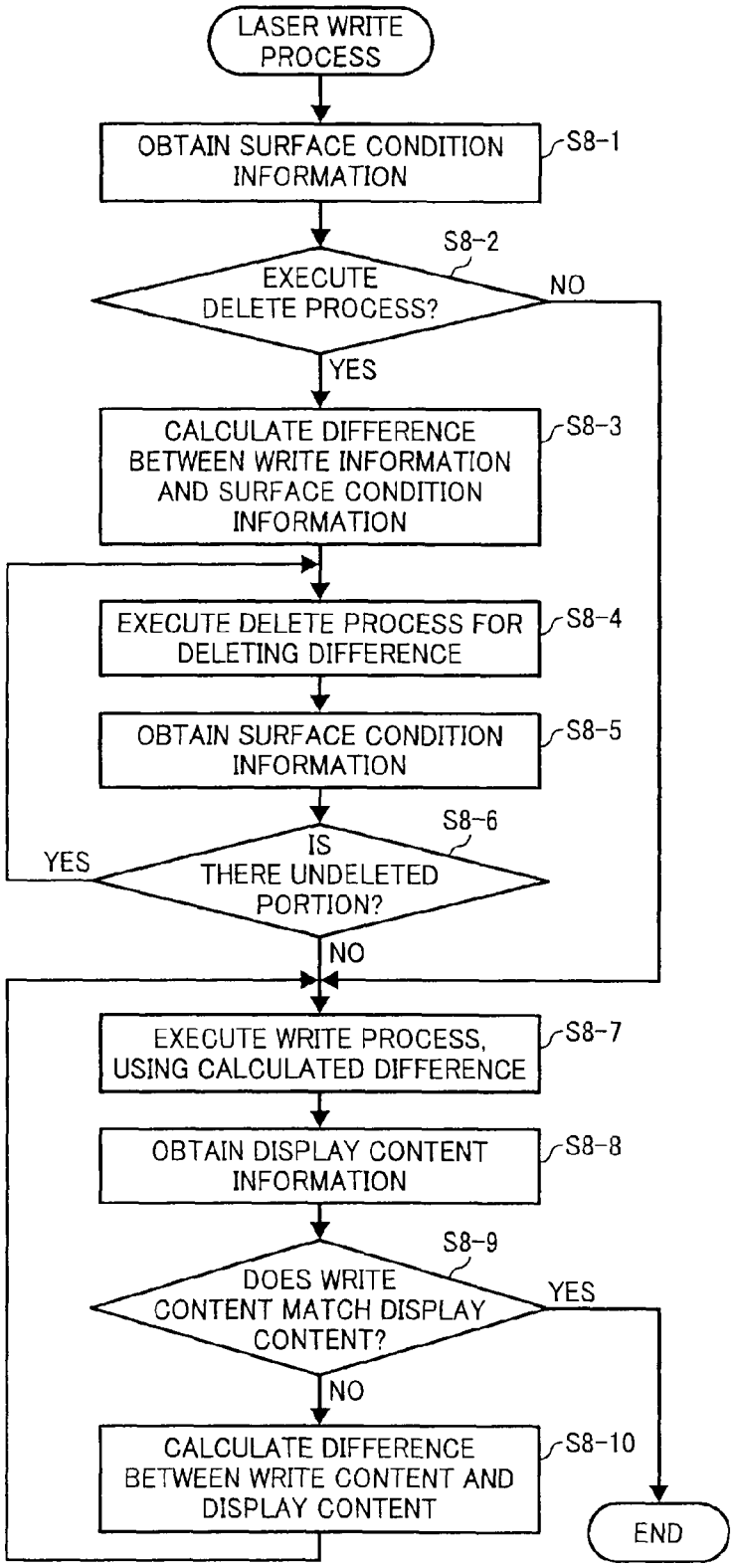

An eighth embodiment of the present invention is explained next with reference to FIG. 9. In the eighth embodiment, the erase process for erasing only a part different from the displayed content and the write process for writing only the different part are executed.

Also in the eighth embodiment, the laser writing apparatus 30 having the same configuration as that in the first embodiment is used. Also in the eighth embodiment, the container 10 is carried by the conveying unit 20. When the surface-condition imaging device 32 detects the container 10, the write control unit 31 obtains the surface condition information as at Step S1-1 (Step S8-1). The write control unit 31 determines whether the erase process is required based on the surface condition information as at Step S1-2 (Step S8-2). When it is determined that the erase process is required (YES at Step S8-2), the write control unit 31 calculates a difference between the write information and the display information (Step S8-3). Specifically, the write control unit 31 transmits the ID data identified from the two-dimensional code to the delivery management server, and obtains the content data associated with the ID data to generate the drawing image based on the content data. The write control unit 31 compares the generated drawing image data with the photographed image data, which is the display status information. The write control unit 31 generates the content data to be additionally written from the difference (different part) between the drawing image data and the photographed image data.

The write control unit 31 executes the erase process for erasing only the difference (different part) (Step S8-4). Specifically, the write control unit 31 transmits a signal to the transport driving unit to control the transport speed of the conveying unit 20 within the erasable speed range. The write control unit 31 controls the erase laser unit 33 to perform laser application for erasing, thereby erasing the image.

The write control unit 31 obtains the surface condition information as at Step S1-4 (Step S8-5). The write control unit 31 determines whether there is unerased area as at Step S1-5 (Step S8-6). When there is the unerased area (YES at Step S8-6), the write control unit 31 executes the erase process again (Step S8-4).

On the other hand, when it is determined that the erase process is not required (NO at Step S8-2) or there is no unerased area (NO at Step S8-6), the write control unit 31 executes the write process, using the calculated difference (different part) (Step S8-7). The write control unit 31 controls the transport speed of the conveying unit 20 within the writable speed range, as at Step S1-6, and determines the scanning range of the laser beams to determine the drawing image data from the generated content data. The write control unit 31 calculates the laser beam intensity according to the display status information. The write control unit 31 controls the write laser unit 35 based on the drawing image data and the laser beam intensity to apply the write laser beams, thereby drawing an image.

The write control unit 31 obtains the display content information as at Step S1-7 (Step S8-8). The write control unit 31 determines whether the write content and the display content match each other as at Step S1-8 (Step S8-9). When the write content does not match the display content (NO at Step S8-9), the write control unit 31 calculates a difference between the write content and the display content as at Step S1-9 (Step S8-10). The write control unit 31 repeatedly executes the process from Steps S8-7 to S8-10. On the other hand, when the write content matches the display content (YES at Step S8-9), the write control unit 31 finishes the laser write process.

According to the eighth embodiment, the effect described below can be obtained in addition to the effects of (1) to (5) in the above embodiment.

(10) In the eighth embodiment, the write control unit 31 obtains the surface condition information of the rewritable recording-medium 50 (Step S8-1). The write control unit 31 calculates the difference between the write information and the display information (Step S8-3), and executes the erase process for erasing only the difference (Step S8-4). The write control unit 31 executes the write process, using the calculated difference (Step S8-7). Because the write control unit 31 erases only the different part (difference) according to the state at the time of writing and executes write only for the difference, laser writing can be performed efficiently.

Figure 10:
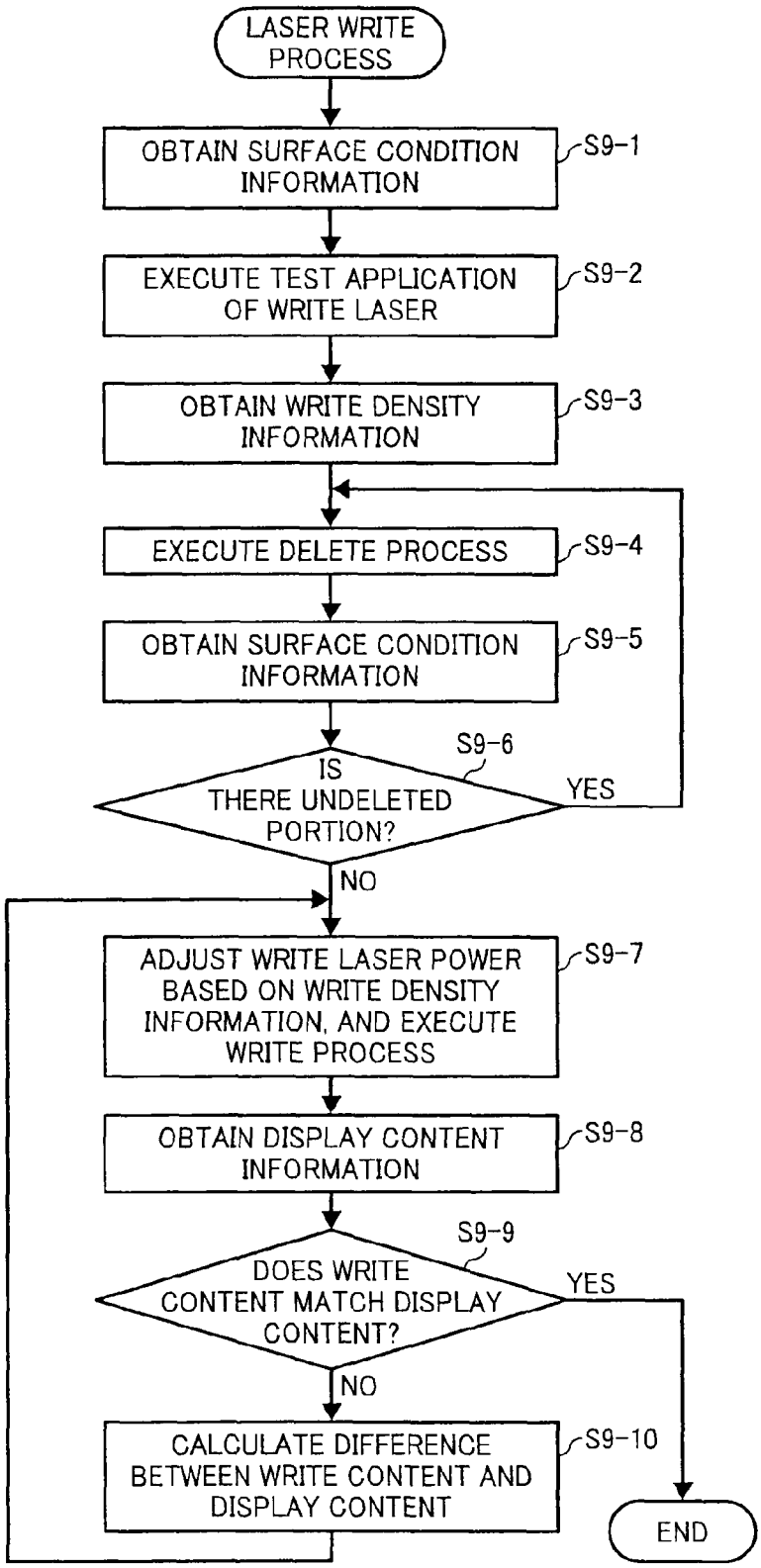
Figure 11:
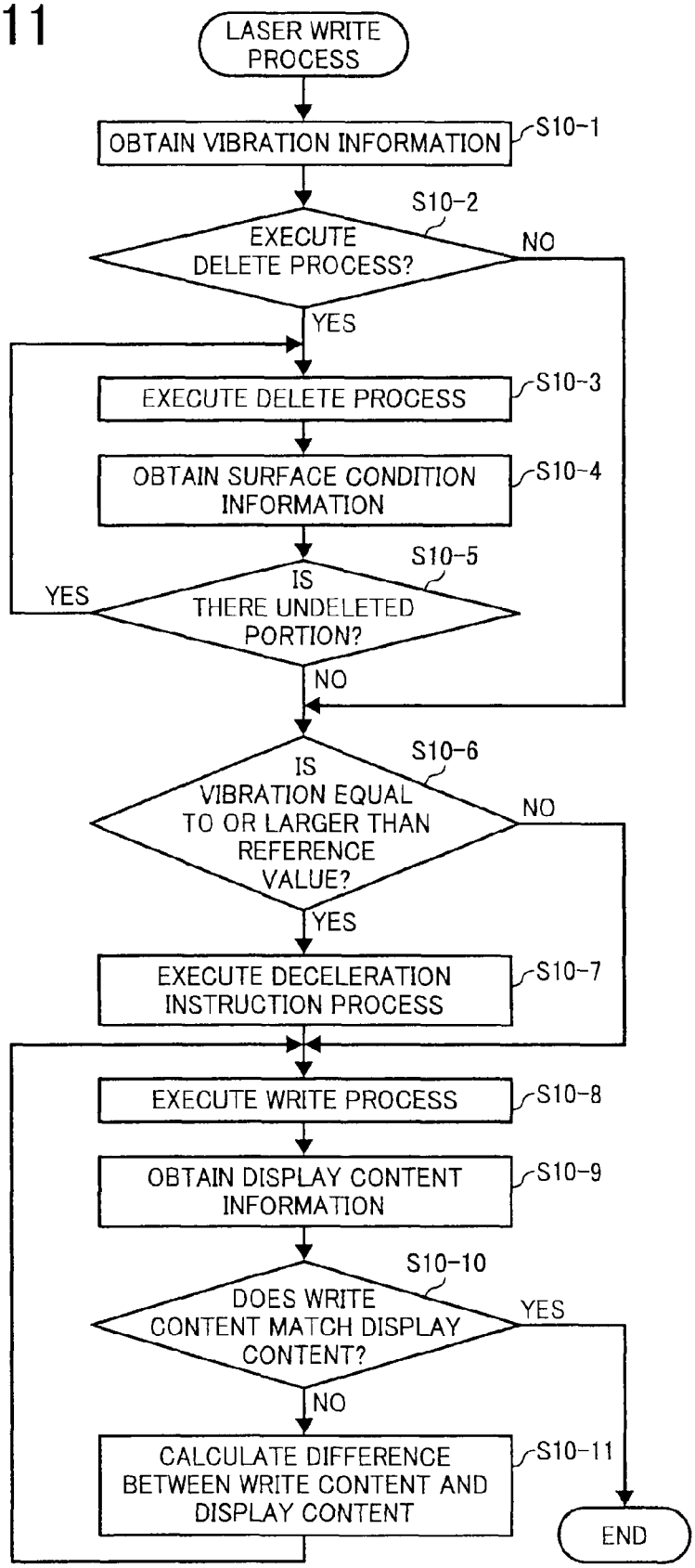

A ninth embodiment of the present invention is explained with reference to FIG. 10. In the ninth embodiment, after the laser is tested, the write laser power is adjusted based on write density information by the tested laser, which is different from the above embodiments.

In the laser writing apparatus in the ninth embodiment, a test-application processing unit is provided between the surface-condition imaging device 32 and the erase processing unit of the laser writing apparatus 30 in the first embodiment.

The test-application processing unit includes a test-application laser unit as a trial-laser output unit and a test-application density imaging device as a grayscale-information obtaining unit.

The test-application laser unit includes a test-application-laser source and an optical mechanical unit as in the write laser unit. The 40-watt $CO_2$ laser is used for the test-application-laser source as in the write laser source. The optical mechanical unit includes a galvanometer and a mirror fitted to the galvanometer as in the optical mechanical unit of the erase laser unit 33. The optical mechanical unit of the test-application laser unit applies the laser beams to a position as a test-application target on the surface (rewritable area) of the rewritable recording-medium identified by the write control unit 31.

The test-application density imaging device photographs an image generated by the laser beams from the test-application laser unit, and transmits the image data to the write control unit 31.

The write control unit 31 in the ninth embodiment identifies an area in which an image is not displayed based on the photographed image data from the test-application density imaging device, determines the test-application target position from the identified area, and controls the test-application laser unit to apply the laser beams with predetermined intensity. The write control unit 31 obtains data relating to the image density by test application of the test-application laser unit from the test-application density imaging device, and adjusts the laser power of the write laser unit 35 based on the image density. For other parts, the write control unit 31 executes the same process as those in the respective embodiments.

A process procedure when the laser write process is executed by using the laser writing apparatus in the ninth embodiment is explained below.

Also in the ninth embodiment, the container 10 is carried by the conveying unit 20. When the surface-condition imaging device 32 detects the container 10, the write control unit 31 obtains the surface condition information as at Step S1-1 (Step S9-1). The write control unit 31 identifies an area where the image is not displayed, based on the surface condition information.

The write control unit 31 executes test application of the laser (Step S9-2). The write control unit 31 determines the test-application target position based on the area where the identified image is not displayed, and controls the test-application laser unit to apply the laser beams to the test-application target position. Accordingly, the test-application laser unit applies trial laser beams to the rewritable area, using the test-application-laser source and the optical mechanical unit.

The test-application density imaging device transmits the photographed image data obtained by photographing the rewritable area, to which the trial laser beams have been applied, to the write control unit 31. In this case, the write control unit 31 obtains write density information (Step S9-3). Specifically, the test-application density imaging device obtains data relating to the coloring state (write density) by the trial laser beams based on the image data of the rewritable area to which the trial laser beams have been applied.

The write control unit 31 executes the erase process as at Step S2-3 (Step S9-4).

The write control unit 31 obtains the surface condition information as at Step S1-4 (Step S9-5). The write control unit 31 determines whether there is unerased area as at Step S1-5 (Step S9-6). When there is the unerased area (YES at Step S9-6), the write control unit 31 executes the erase process again (Step S9-4).

On the other hand, when all the unerased areas are erased (NO at Step S9-6), the write control unit 31 adjusts the write laser power according to the write density information to execute the write process (Step S9-7). The write control unit 31 first controls the transport speed of the conveying unit 20 within the writable speed range, determines the scanning range of the laser beams, obtains the content data associated with the ID data from the delivery management server, and generates the drawing image data from the content data, as at Step S1-6. The write control unit 31 calculates the laser beam intensity according to the write density by the trial laser beams. The write control unit 31 controls the write laser unit 35 based on the drawing image data and the laser beam intensity, to apply the write laser beams, thereby drawing an image.

The write control unit 31 obtains the display content information as at Step S1-7 (Step S9-8). The write control unit 31 determines whether the write content and the display content match each other as at Step S1-8 (Step S9-9). When the write content does not match the display content (NO at Step S9-9), the write control unit 31 calculates a difference between the write content and the display content as at Step S1-9 (Step S9-10). The write control unit 31 repeatedly executes the process from Steps S9-7 to S9-10. On the other hand, when the write content matches the display content (YES at Step S9-9), the write control unit 31 finishes the laser write process.

According to the ninth embodiment, the effects described below can be obtained in addition to the effects of (1) to (5) of the above embodiments.

(11) In the ninth embodiment, the write control unit 31 executes test application of the laser (Step S9-2), and obtains the write density information based on the photographed image data obtained by photographing the rewritable area, to which the trial laser beams have been applied (Step S9-3). The write control unit 31 adjusts the write laser power according to the write density information to execute the write process (Step S9-7). Accordingly, the coloring state of the respective rewritable recording-medium 50 can be confirmed, thereby performing laser writing suitable for the respective rewritable recording-medium 50.

(12) The write control unit 31 obtains the surface condition information of the rewritable recording-medium 50 (Step S9-1) to identify an area where an image is not displayed. When executing test application of the laser (Step S9-2), the write control unit 31 determines the test-application target position based on the area where the image is not displayed, and applies the laser beams to the test-application target position. Accordingly, it can be prevented that laser application is performed again with respect to an area where there is some display, and therefore write density by the test-application laser unit can be obtained more accurately.

A tenth embodiment of the present invention is explained next. In the tenth embodiment, the write process is executed based on vibration information of the container 10 attached with the rewritable recording-medium 50, different from the first to the third embodiments.

Also in the tenth embodiment, the laser writing apparatus 30 having the same configuration as that in the first embodiment is used. Further, the surface-condition imaging devices 32 and 34 in the laser writing apparatus 30 in the tenth embodiment transmit the photographed motion picture data to the write control unit 31. The write control unit 31 obtains vibration data (vibration amplitude, period, and the like) based on the received motion picture data, and extracts still picture data from the motion picture data, thereby obtaining the surface condition from the still picture data.

Also in the tenth embodiment, the container 10 is carried by the conveying unit 20. When the surface-condition imaging device 32 detects the container 10, the surface-condition imaging device 32 photographs the surface (rewritable display area) of the rewritable recording-medium 50 on the container 10. In the tenth embodiment, a motion picture is photographed, and the motion picture data is transmitted to the write control unit 31.

The write control unit 31 obtains the vibration information based on the received motion picture data (Step S10-1). The write control unit 31 identifies the vibration amplitude and period based on the obtained motion picture data. Further, in the tenth embodiment, the write control unit 31 extracts the still picture data from the motion picture data, to obtain the surface condition information from the still picture data.

The write control unit 31 then determines whether the erase process is required based on the obtained image data as at Step S1-2 (Step S10-2). When it is determined that the erase process is required (YES at Step S10-2), the write control unit 31 adjusts the erase laser power according to the obtained vibration amplitude and period, to execute the erase process (Step S10-3). Specifically, the write control unit 31 adjusts the speed of the erase laser beams and the scanning timing according to the vibration information. The write control unit 31 controls the erase laser unit 33 to perform laser application for erasing, to erase the image.

The write control unit 31 then obtains the surface condition information as at Step S1-4 (Step S10-4). The write control unit 31 determines whether there is unerased area as at Step S1-5 (Step S10-5). When there is the unerased area (YES at Step S10-5), the write control unit 31 executes the erase process again (Step S10-3).

On the other hand, when it is determined that the erase process is not required (NO at Step S10-2) or there is no unerased area (NO at Step S10-5), the write control unit 31 determines whether the obtained vibration is equal to or larger than a reference value (Step S10-6). Specifically, for example, when the vibration amplitude is equal to or larger than a predetermined value, and a predetermined period is equal to or larger than a predetermined value based on the obtained vibration, the write control unit 31 determines that the vibration is equal to or larger than the reference value (YES at Step S10-6). In this case, the write control unit 31 executes a deceleration instruction process (Step S10-7). The write control unit 31 first transmits a signal to the transport driving unit to control the transport speed of the conveying unit 20 within the writable speed range. When the vibration is less than the reference value (NO at Step S10-6), the write control unit 31 skips the process at Step S10-7.

The write control unit 31 executes the write process (Step S10-8). First, the write control unit 31 determines the scanning range of the laser beams, obtains the content data associated with the ID data from the delivery management server, and generates the drawing image data from the content data, as at Step S1-6. The write control unit 31 further calculates the laser beam intensity according to the surface condition information. The write control unit 31 then controls the write laser unit 35 based on the drawing image data and the laser beam intensity, to apply the write laser beams, thereby drawing an image.

The write control unit 31 obtains the display content information as at Step S1-7 (Step S10-9). The write control unit 31 determines whether the write content and the display content match each other as at Step S1-8 (Step S10-10). When the write content does not match the display content (NO at Step S10-10), the write control unit 31 calculates a difference between the write content and the display content as at Step S1-9 (Step S10-11). The write control unit 31 repeatedly executes the process from Steps S10-8 to S10-11. On the other hand, when the write content matches the display content (YES at Step S10-10), the write control unit 31 finishes the laser write process.

According to the tenth embodiment, the effect described below can be obtained in addition to the effects of (1) to (5) of the above embodiments.

(13) In the tenth embodiment, the write control unit 31 obtains the vibration information based on the received motion picture data (Step S10-1), to determine whether the obtained vibration is equal to or larger than the reference value (Step S10-6). For example, when the vibration amplitude is equal to or larger than a predetermined value, and the predetermined period is equal to or larger than a predetermined value, the write control unit 31 determines that the vibration is equal to or larger than the reference value (YES at Step S10-6). In this case, the write control unit 31 executes the deceleration instruction process (Step S10-7), and executes the write process (Step S10-8). Accordingly, even when the vibration is large, laser beams can be applied to the rewritable recording-medium 50 more reliably, thereby enabling more accurate drawing (display) of the image on the rewritable recording-medium 50.

Figure 12:
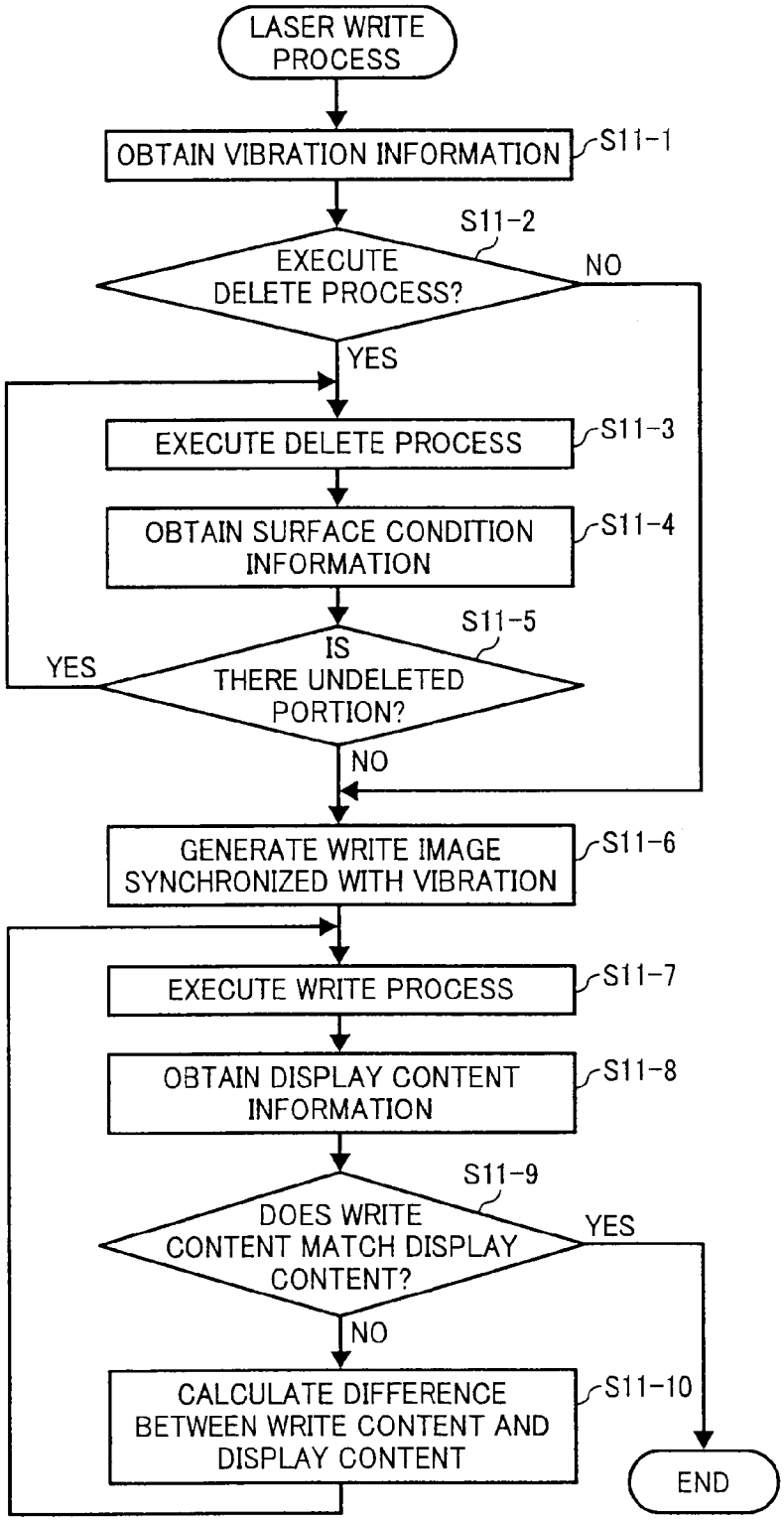

An eleventh embodiment of the present invention is explained next with reference to FIG. 12. In the eleventh embodiment, the write process is executed based on the vibration information of the container 10 as in the tenth embodiment; however, the process immediately before the write process is different from that of the tenth embodiment.

Also in the eleventh embodiment, the laser writing apparatus 30 having the same configuration as that in the tenth embodiment is used.

Also in the eleventh embodiment, the container 10 is carried by the conveying unit 20. When the surface-condition imaging device 32 has detected the container 10, the write control unit 31 obtains the vibration information based on the received motion picture data as at Step S10-1 (Step S11-1).

The write control unit 31 determines whether the erase process is required as at Step S10-2 (Step S11-2). When it is determined that the erase process is required (YES at Step S11-2), the write control unit 31 executes the erase process as at Step S10-3 (Step S11-3).

The write control unit 31 obtains the surface condition information as at Step S10-4 (Step S11-4). The write control unit 31 determines whether there is unerased area as at Step S10-5 (Step S11-5). When there is the unerased area (YES at Step S11-5), the write control unit 31 executes the erase process again (Step S11-3).

On the other hand, when it is determined that the erase process is not required (NO at Step S11-2) or there is no unerased area (NO at Step S11-5), the write control unit 31 generates the write image synchronized with the vibration (Step S11-6). The write control unit 31 determines the scanning range of the laser beams, obtains the content data associated with the ID data from the delivery management server, and generates the drawing image data from the content data, as at Step S1-6. The write control unit 31 also determines a scanning track of the laser application based on the drawing image data and the vibration amplitude and period.

The write control unit 31 executes the write process (Step S11-7). The write control unit 31 controls the write laser unit 35 to apply the scanning track of the generated write image with the laser beams having a constant intensity, thereby drawing an image.

The write control unit 31 obtains the display content information as at Step S1-7 (Step S11-8). The write control unit 31 determines whether the write content and the display content match each other as at Step S1-8 (Step S11-9). When the write content does not match the display content (NO at Step S11-9), the write control unit 31 calculates a difference between the write content and the display content as at Step S1-9 (Step S11-10). The write control unit 31 repeatedly executes the process from Steps S11-7 to S11-10. On the other hand, when the write content matches the display content (YES at Step S11-9), the write control unit 31 finishes the laser write process.

According to the eleventh embodiment, the effect described below can be obtained in addition to the effects of (1) to (5) of the above embodiments.

(14) The write control unit 31 obtains the vibration information based on the received motion picture data (Step S11-1), generates the write image synchronized with the obtained vibration (Step S11-6), and executes the write process (Step S11-7). Accordingly, because the laser beams can be applied to the rewritable recording-medium rewritable recording-medium 50 more accurately, an image can be displayed on the rewritable recording-medium 50 more accurately.

Figure 13:
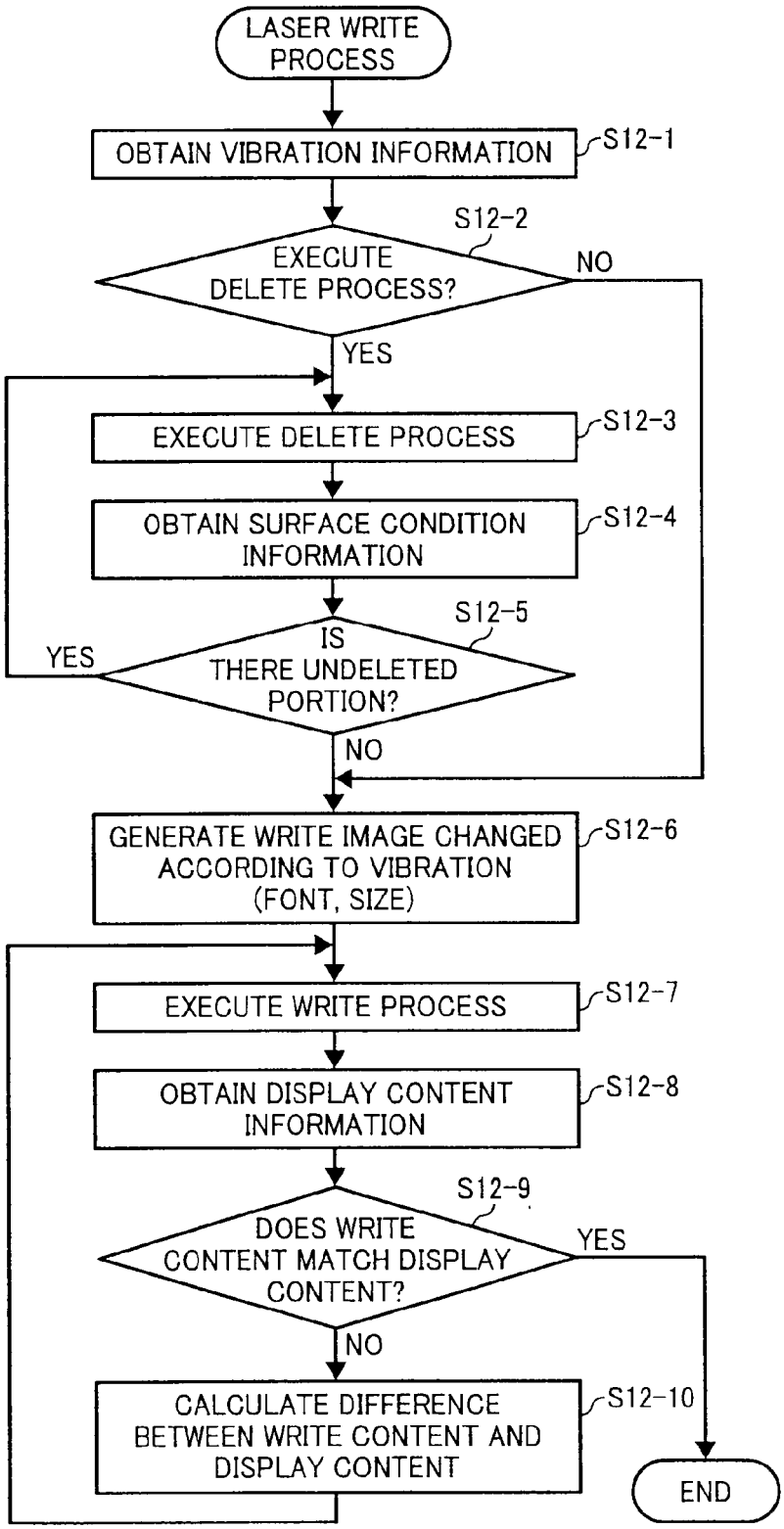

A twelfth embodiment of the present invention is explained next with reference to FIG. 13. In the twelfth embodiment, the write process is executed based on the vibration information of the container 10 as in the tenth embodiment. However, the process immediately before the write process is different from the tenth and the eleventh embodiments.

Also in the twelfth embodiment, the laser writing apparatus 30 having the same configuration as that in the tenth embodiment is used. The write control unit 31 in the twelfth embodiment stores data relating to font and size (display mode) of characters used according to the vibration. For example, when the amplitude value is large or the vibration period is short, the character font and size are set to those having high visibility even if the image is blurred.

Also in the second embodiment, the container 10 is carried by the conveying unit 20. When the surface-condition imaging device 32 detects the container 10, the write control unit 31 obtains the vibration information based on the received motion picture data as at Step S10-1 (Step S12-1).

Next, the write control unit 31 determines whether the erase process is required as at Step S10-2 (Step S12-2). When it is determined that the erase process is required (YES at Step S12-2), the write control unit 31 executes the erase process as at Step S10-3 (Step S12-3).

The write control unit 31 obtains the surface condition information as at Step S1-4 (Step S12-4). The write control unit 31 determines whether there is unerased area as at Step S1-5 (Step S12-5). When there is the unerased area (YES at Step S11-5), the write control unit 31 executes the erase process again (Step S12-3).

On the other hand, when it is determined that the erase process is not required (NO at Step S12-2) or there is no unerased area (NO at Step S12-5), the write control unit 31 generates a write image changed corresponding to the vibration (Step S12-6). Specifically, the write control unit 31 transmits the ID data of the bar code included in the image data to the delivery management server, and obtains the content data associated with the ID data from the delivery management server. The write control unit 31 obtains the image data, using the character font or size corresponding to the vibration of the conveying unit 20, based on the received content data and the obtained vibration amplitude and period.

The write control unit 31 executes the write process (Step S12-7). The write control unit 31 controls the transport speed of the conveying unit 20 within the writable speed range, and determines the scanning range of the laser beams as at Step S1-6. Further, the write control unit 31 determines the scanning track of the laser application based on the write image data generated at Step S12-6 and the vibration amplitude and period. The write control unit 31 controls the write laser unit 35 to apply the scanning track with the laser beams having a constant intensity, thereby drawing an image.

The write control unit 31 obtains the display content information as at Step S1-7 (Step S12-8). The write control unit 31 determines whether the write content and the display content match each other as at Step S1-8 (Step S12-9). When the write content does not match the display content (NO at Step S12-9), the write control unit 31 calculates a difference between the write content and the display content as at Step S1-9 (Step S12-10). The write control unit 31 repeatedly executes the process from Steps S12-7 to S12-10. On the other hand, when the write content matches the display content (YES at Step S12-9), the write control unit 31 finishes the laser write process.

According to the twelfth embodiment, the effect described below can be obtained in addition to the effects of (1) to (5) in the above embodiment.

(15) In the twelfth embodiment, the write control unit 31 obtains the vibration information based on the received motion picture data (Step S12-1), and generates the write image corresponding to the obtained vibration (Step S12-6) to execute the write process (Step S12-7). Accordingly, for example, when the vibration is large, the image data is generated by using easily visible character font and size based on the content data to perform write laser application based on the image data, thereby enabling to display an image including characters having excellent visibility.

The above embodiments can be changed as follows.

In the fifth embodiment, the surface-condition imaging device (32, 34, and 36) obtains the photographed image data of the rewritable recording-medium 50 attached to the other side of the opposite surface. The laser beams are applied to the rewritable recording-medium 50 attached to the other side of the opposite surface. Alternatively, when the rewritable recording-medium 50 is provided on an adjacent face, a photographing assisting unit such as a mirror can be provided so that the information on the arrangement of the surface, on which the rewritable recording-medium 50 can be provided, is obtained by the surface-condition imaging device (32, 34, and 36). A laser-application assisting unit such as a mirror can be provided so that the laser beams can be applied to the respective surfaces. The rewritable recording-medium 50 can be provided on two or more surfaces.

In the fifth embodiment, the information on the arrangement is obtained from the surface-condition imaging device 32. When an IC tag is provided on the rewritable recording-medium 50, the information on the arrangement of the rewritable recording-medium 50 can be recorded in a memory of the IC tag. In this case, the write control unit 31 obtains the information on the arrangement recorded in the memory via an antenna. The write control unit 31 transmits the control signal to the transport driving unit to change the direction of the container 10 so that the rewritable recording-medium 50 on the container 10 faces the erase laser unit 33 or the write laser unit 35 based on the obtained information on the arrangement.

In the sixth embodiment, the brightness measured by the surface-condition imaging device 32 at the time of using the write laser unit 35 is used. However, the present invention is not limited thereto, and the environmental brightness at the time of using the rewritable recording-medium 50 can be used as the environmental information to be used. For example, the surface-condition imaging device 32 is arranged on the downstream of the write laser unit 35, and the brightness obtained by the surface-condition imaging device 32 can be used as the environmental information. The means for obtaining site requirements information is not limited to the surface-condition imaging device 32 in the sixth embodiment and can be an environmental information database that records the site requirements information (brightness and the like) for each used place. In this case, the used place of the rewritable recording-medium 50 is recorded in, for example, the delivery management server in association with the ID data. When the ID data is obtained from the two-dimensional code, the write control unit 31 can obtain data relating to the used place associated with the ID data, and obtain the site requirements information associated with the used place from the environmental information database.

In the seventh embodiment, the laser power of the erase laser or the write laser is adjusted based on the surface temperature information. Alternatively, when the surface temperature is high, the laser can be set to defocus to enlarge the laser applying area. Accordingly, the surface temperature can be decreased and set to a suitable temperature. Because the laser applying area is increased, the erasing can be performed in a short period of time.

In the above embodiments, the write control unit 31 obtains the content data from the delivery management server. However, the present invention is not limited thereto, and the content data can be pre-stored in the write control unit 31. In this case, the write control unit 31 identifies the content data corresponding to the obtained ID, and generates the drawing image data based on the content data.

In the above embodiments, the two-dimensional code, from which the write control unit 31 obtains the ID data, is displayed on the rewritable recording-medium 50. However, the present invention is not limited thereto, and after the data is obtained from the two-dimensional code, the data can be erased by the erase process (for example, Step S1-3 in the first embodiment), and can be drawn again in the write process (Step S1-6). In this case, because an image including the two-dimensional code can be rewritten, the data included in the drawn two-dimensional code can be obtained more accurately.

In the above embodiments, the write control unit 31 obtains the ID data associated with the content data from the two-dimensional code displayed on the rewritable recording-medium 50. However, the present invention is not limited thereto, and when the rewritable recording-medium 50 with the IC tag is used, the ID data can be obtained from the memory of the IC tag.

In the above embodiments, when there is the unerased area (for example, YES at Step S1-5 in the first embodiment), the write control unit 31 repeatedly executes the erase process. In this case, when the erase process is repeatedly performed for a predetermined number of times or more, the write control unit 31 can perform the write process or can take out the container 10 attached with the rewritable recording-medium 50 from the transport route even when the write content does not match the display content.

In the above embodiments, the write control unit 31 determines whether the write content and the display content match each other after finishing the write process (Step S1-8). In this case, a filter can be provided according to the write density so that the write control unit 31 can determine whether the write content and the display content match each other. Specifically, the write control unit 31 stores density threshold data with respect to write density data. The write control unit 31 determines that there is no write content in the photographed image data obtained from the surface-condition imaging device 36, if the density is below the stored density threshold. Accordingly, write is performed again with respect to a part having a low density and hardly visible, thereby enabling to display an image on the rewritable recording-medium rewritable recording-medium 50 more reliably.

In the above embodiments, the write control unit 31 repeatedly executes the write process (for example, Step S1-6 in the first embodiment) until the write content and the display content match each other. In this case, when the write process is repeated for the predetermined number of times or more, the write control unit 31 can finish the write process, even when the write content and the display content do not match each other.

In the above embodiments, when the write process performed by using a difference (for example, Step S1-6 executed after Step S1-9 in the first embodiment) is repeated for the predetermined number of times or more, control can return to the erase process (Step S1-3) to perform the process. In this case, write is not performed with respect to the difference, but all the images are rewritten. Therefore, when the write content and the display content do not match each other due to no matching with an added part, a more accurate image can be displayed.

In the above embodiments, the erase laser unit 33 is used as the erasing unit. However, the erasing unit is not limited thereto, and for example, hot air or an infrared heater can be used. When the hot air is used, because the hot air can heat a wider area than in the case of using the laser, the erasing can be performed in a short period of time. When the infrared heater is used, the infrared heater can erase the wide area more efficiently than the hot air. Not only the rewritable recording-medium 50 is heated, but also the container 10 added with the rewritable recording-medium 50 can be heated.

In the above embodiments, the erase laser unit 33 and the write laser unit 35 are individually provided. However, the present invention is not limited thereto, and the erasing can be performed by decreasing the laser output of the write laser unit 35. In this case, at the time of performing the erase process and the write process, the intensity of the applied laser beams is changed to change the temperature on the surface of the rewritable recording-medium 50. Specifically, in the case of erasing, the laser is set to defocus as compared to the write process, to enlarge the laser applying area. Accordingly, because the erase process and the write process can be performed by one laser unit, space saving can be achieved. Alternatively, the erase process and the write process can be performed by changing the position of the container back and forth to change the focus, without changing the unit itself in one laser unit. In this case, the write control unit 31 controls such that the laser applying timing in the erase process and the write process is synchronized with the movement of the container. Accordingly, erase and write can be performed with less resource.

In the above embodiments, the $CO_2$ laser is used as the laser source. However, the present invention is not limited thereto, and Yttrium Aluminum Garnet (YAG) laser, fiber laser, semiconductor laser (LD), or the like can be used. For example, the wavelength of the YAG laser, the fiber laser, and the LD is in a range of from visible radiation to near infrared (several hundreds micrometers to 1.2 micrometers), in which addition of a photothermal conversion material that absorbs and converts the laser beams to heat is required. However, because the wavelength is short, highly detailed image can be formed. Because the YAG laser and the fiber laser have high power, the erase process and the write process can be performed in a short period of time. Further, because the laser itself in the LD is small, miniaturization of the apparatus and cost reduction can be realized.

In the above embodiments, the rewritable display area is formed of a rewritable thermal recording medium, in which tone changes reversibly depending on the temperature. Alternatively, a rewritable thermal recording medium, in which transparency changes reversibly depending on the temperature, can be used. In the rewritable thermal recording medium, in which transparency changes reversibly, in the recording layer, particles of an organic low-molecular substance are dispersed in a resin matrix as a main component. By changing the thermal energy to be applied to the recording layer, the transparency reversibly changes between a cloudy state and a transparent state. Generally, application of the thermal energy includes a temperature range to become transparent, and the rewritable thermal recording medium utilizes the change of transparency between the transparent state and the cloudy state. This mechanism is presumed as follows. That is, when the recording medium is transparent, in the particles of the organic low-molecular substance dispersed in the resin matrix, the organic low-molecular substance and the resin matrix adhere to each other without any gap, and there is no gap in the particle. Therefore, the light incident from one side is transmitted to the other side without being scattered, and therefore the recording medium looks transparent. When the recording medium is cloudy, the particles of the organic low-molecular substance are formed of fine crystals of the organic low-molecular substance, and therefore, there are gaps in the interfaces of the crystals or in the interfaces between the particles and the resin matrix. Therefore, the light incident from one side is refracted and scattered in the interfaces between the gap and the crystal and between the gap and the resin, and therefore the recording medium looks cloudy. As a representative example, there is a thermal layer in which the organic low-molecular substance such as higher alcohol or higher fatty acid is dispersed in the resin matrix such as polyester.

As described above, according to an aspect of the present invention, because the control unit can apply the write laser beams according to the surface condition of the rewritable display medium, laser writing suitable for the writing state can be performed efficiently. The "information of the surface condition" includes not only the state of the image displayed on the surface and an uneven state of the surface, but also an environmental state of the surface (brightness, atmosphere, and the like) and surface temperature. Further, the "adjustment of the laser-beam applying condition" includes not only the adjustment of a laser power, an applying position of the laser, and applying timing, but also adjustment of the image content used in laser application, adjustment of the transport unit at the time of laser application, and adjustment of the surface condition of the rewritable display medium, to which the write-laser output unit applies laser beams, by executing the erase process.

Furthermore, according to another aspect of the present invention, because the control unit can execute the erase process efficiently with respect to the rewritable display medium, an image to be displayed by the write process can be displayed more reliably.

Moreover, according to still another aspect of the present invention, the control unit identifies the area where the display content does not match the write content based on the writing state, and executes erase and write with respect to this area. Therefore, laser writing can be efficiently performed.

Furthermore, according to still another aspect of the present invention, because the write process can be executed in a state where there is no unerased area, the image to be displayed by the write process can be displayed more reliably.

Moreover, according to still another aspect of the present invention, the control unit executes the write process again only with respect to the identified area so that an insufficient area is displayed. Accordingly, the write content to be displayed can be displayed efficiently and more reliably.

Furthermore, according to still another aspect of the present invention, because the control unit adjusts the energy level according to the writing state, laser writing can be performed efficiently.

Moreover, according to still another aspect of the present invention, the control unit adjusts the energy level, for example, based on the grayscale information. The grayscale information includes, for example, a change in the image due to stain or a change with the lapse of time. Therefore, laser writing corresponding to the current surface condition of the rewritable display medium can be performed.

Furthermore, according to still another aspect of the present invention, laser writing suitable for coloring state of respective rewritable display media can be performed.

Moreover, according to still another aspect of the present invention, laser beams can be applied, taking the surface temperature of the rewritable display medium into consideration. For example, when the surface temperature is high, weaker laser beams are applied, thereby enabling to avoid deterioration of the rewritable display medium. When the surface temperature is low, stronger laser beams are applied, to display an image more reliably.

Furthermore, according to still another aspect of the present invention, laser beams can be applied, taking the environment such as brightness into consideration. For example, by displaying an image having high density in a bright place, and an image having low density in a dark place, characters and images having excellent visibility can be displayed.

Moreover, according to still another aspect of the present invention, a curved or inclined state can be ascertained by measuring the distance from the surface-condition-information obtaining unit to the rewritable display medium, when there is a curvature (curved surface) on the rewritable display medium, or when the rewritable display medium is fitted with an inclination. In this case, the energy level is adjusted, taking the curvature and the inclination into consideration. Accordingly, deterioration of the rewritable display medium due to strong application of laser beams and insufficient display of the image due to weak application of laser beams can be avoided.

Furthermore, according to still another aspect of the present invention, arrangement of the rewritable display medium provided on a plurality of faces of the object to be managed can be identified, and an image suitable for each rewritable display medium can be displayed efficiently.

Moreover, according to still another aspect of the present invention, even if vibrations are large, laser beams can be applied to the rewritable display medium more reliably. Accordingly, an image can be displayed on the rewritable display medium more accurately.

Furthermore, according to still another aspect of the present invention, because the laser beams can be applied to the rewritable display medium more reliably, an image can be displayed on the rewritable display medium more accurately.

Moreover, according to still another aspect of the present invention, for example, when the vibrations are large, characters and images having excellent visibility can be displayed by using easily visible characters or large characters to generate image data, and applying laser beams based on the image data.

Furthermore, according to still another aspect of the present invention, laser writing suitable for the state at the time of writing can be efficiently performed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An apparatus for erasing and writing a predetermined image on a target object to be managed, wherein the predetermined image is reversibly displayed visually on a surface of a rewritable display medium which is provided on the target object, the apparatus comprising:

an erasing unit that heats the surface of the rewritable display medium to erase a previous image reversibly displayed on the surface of the rewritable display medium;

a surface-condition-information obtaining unit that obtains information on a condition of the surface of the rewritable display medium;

a write-laser output unit that outputs a write laser to irradiate the rewritable display medium with the write laser to draw the predetermined image on the surface of the rewritable display medium so that the predetermined image is reversibly displayed on the surface of the rewritable display medium; and a control unit that performs an erase process by causing the erasing unit to erase the previous image on the surface of the rewritable display medium, and then performs a write process by causing the write-laser output unit to draw the predetermined image on the surface of the rewriteable display medium, wherein the control unit adjusts heat output from the erasing unit during the erase process depending on the information on the condition of the surface of the rewritable display medium, which has been obtained by the surface-condition-information obtaining unit before the erase process is executed.

2. The apparatus according to claim 1, wherein the control unit compares the previous image displayed on the surface of the rewritable display medium, which is derived from the information, which has been obtained by the surface-condition-information obtaining unit before the erase process is executed, with the predetermined image to be drawn in the write process to identify a difference therebetween, controls the erasing unit to erase at least a portion of the previous image in an area corresponding to the difference, and controls the write-laser output unit to draw at least a portion of the predetermined image in the area corresponding to the difference.

3. The apparatus according to claim 1, further comprising:

a detecting unit that obtains information on a condition of the surface of the rewritable display medium after the erase process has been executed, wherein when the control unit determines that the previous image is an unerased image that remains on the surface based on the information on the condition of the surface, which as been obtained by the detecting unit, the control unit executes the erase process again, and when the control unit determines that the unerased image does not remain on the surface, the control unit executes the write process.

4. The apparatus according to claim 1, further comprising:

an image verifying unit that obtains image data of the predetermined image displayed on the surface of the rewritable display medium, to which the write process has been executed, wherein the control unit compares the predetermined image displayed on the surface, which is derived from the image data obtained by the image verifying unit, with the predetermined image to be drawn in the write process, and when the control unit determines that there is a difference between the predetermined image displayed on the surface and the predetermined image to be drawn, the control unit executes the write process again.

5. The apparatus according to claim 1, further comprising:

a detecting unit that obtains information on a condition of the surface of the rewriteable display medium after the erase process has been executed, wherein the control unit adjusts write laser power from the write-laser output unit depending on the information on the surface of the rewritable display medium, which has been obtained by the detecting unit.

6. The apparatus according to claim 1, wherein the surface-condition-information obtaining unit photographs the rewritable display medium, and the control unit identifies the previous image displayed on the rewritable display medium based on an image of the surface of the rewritable display medium photographed by the surface-condition-information obtaining unit and adjust the heat output from the erasing unit depending on the previous image displayed on the rewritable display medium, which has been identified by the control unit.

7. The apparatus according to claim 1, further comprising:

a trial-laser output unit that outputs a trial laser; and a grayscale-information obtaining unit that photographs the surface of the rewritable display medium that is irradiated with the trial laser by the trial-laser output unit, wherein the control unit obtains grayscale information of the surface of the rewritable display medium based on an image of the surface photographed by the grayscale-information obtaining unit, and adjusts write laser power from the write-laser output unit depending on the grayscale information and an energy level of the trial laser.

8. The apparatus according to claim 5, wherein the surface-condition-information obtaining unit obtains information on temperature of the surface of the rewritable display medium before the erase process, the detecting unit obtains information on temperature of the surface of the rewritable display medium after the erase process and before the write process, and the control unit adjusts the heat output from the erasing unit depending on the information on temperature of the surface of the rewritable display medium obtained by the surface-condition-information obtaining unit, and adjust write laser power from the write-laser output unit depending on the information on temperature of the surface of the rewritable display medium obtained by the detecting unit.

9. The apparatus according to claim 1, wherein the surface-condition-information obtaining unit obtains environmental information, and the control unit adjust the heat output from the erasing unit and write laser power from the write-laser output unit depending on the environmental information.

10. The apparatus according to claim 5, wherein the surface-condition-information obtaining unit obtains information on a distance to the rewritable display medium from the erasing unit, the detecting unit obtains information on a distance to the rewritable display medium from the write-laser output unit, and the control unit adjusts the heat output from the erasing unit depending on the information on the distance obtained by the surface-condition-information obtaining unit, and adjust write laser power from the write-laser output unit depending on the information on the distance obtained by the detecting unit.

11. The apparatus according to claim 1, wherein the surface-condition-information obtaining unit photographs at least two sides of the target object, and the control unit identifies information on a side from the at least two sides of the target object the rewritable display medium is arranged based on images of the at least two sides of the target object photographed by the surface-condition-information obtaining unit, and adjusts the heat output from the erasing unit and write laser power from the write-laser output unit depending on that information.

12. The apparatus according to claim 1, wherein the surface-condition-information obtaining unit obtains information on a vibration of the target object conveyed by a conveying unit, and when the control unit determines that a level of the vibration, which is derived from the information on the vibration obtained by the surface-condition-information obtaining unit, is equal to or larger than a predetermined threshold, the control unit adjusts a conveying speed of the conveying unit.

13. The apparatus according to claim 1, wherein the surface-condition-information obtaining unit obtains information on a vibration of the target object conveyed by a conveying unit, and the control unit adjusts output of the write laser to synchronize with the vibration, based on the information on the vibration.

14. The apparatus according to claim 1, wherein the surface-condition-information obtaining unit information on a vibration of the target object conveyed by a conveying unit, and the control unit adjusts an image drawn by the write-laser output unit by selecting font and/or size of characters used in the image depending on the information on the vibration obtained by the surface-condition-information obtaining unit.

* * * * *